US009211754B2

(12) United States Patent
Zehetner et al.

(10) Patent No.: US 9,211,754 B2
(45) Date of Patent: Dec. 15, 2015

(54) STAMP AND ASSOCIATED STAMP PAD

(75) Inventors: Markus Zehetner, Leonding (AT); Peter Zindl, Marchtrenk (AT)

(73) Assignee: Trodat GmbH (AT)

( * ) Notice: Subject to any disclaimer, the term of this patent is extended or adjusted under 35 U.S.C. 154(b) by 604 days.

(21) Appl. No.: 13/479,866

(22) Filed: May 24, 2012

(65) Prior Publication Data

US 2012/0297998 A1 Nov. 29, 2012

(30) Foreign Application Priority Data

May 24, 2011 (AT) ..... A 756/2011
Nov. 23, 2011 (AT) ..... A 1733/2011

(51) Int. Cl.

| | |
|---|---|
| ***B41K 1/52*** | (2006.01) |
| ***B41K 1/40*** | (2006.01) |
| ***B41K 1/36*** | (2006.01) |
| ***B41K 1/32*** | (2006.01) |
| ***B41K 1/38*** | (2006.01) |
| ***B41K 1/00*** | (2006.01) |
| ***B41K 1/02*** | (2006.01) |
| ***B41K 1/42*** | (2006.01) |
| ***B41K 1/54*** | (2006.01) |

(52) U.S. Cl.

CPC . *B41K 1/40* (2013.01); *B41K 1/006* (2013.01); *B41K 1/02* (2013.01); *B41K 1/32* (2013.01); *B41K 1/36* (2013.01); *B41K 1/38* (2013.01); *B41K 1/42* (2013.01); *B41K 1/52* (2013.01); *B41K 1/54* (2013.01)

(58) Field of Classification Search

CPC ..... B41K 1/02; B41K 1/006; B41K 1/36; B41K 1/38; B41K 1/40; B41K 1/42; B41K 1/54

USPC ..... 101/104, 327, 333, 334, 405

See application file for complete search history.

(56) References Cited

U.S. PATENT DOCUMENTS

| | | | | | |
|---|---|---|---|---|---|
| 2,884,858 | A * | 5/1959 | Boekeloo et al. | ..... | 101/327 |
| 3,216,352 | A * | 11/1965 | Schnackel | ..... | 101/333 |
| 4,805,529 | A * | 2/1989 | Becher | ..... | 101/334 |
| 5,740,737 | A * | 4/1998 | Polak et al. | ..... | 101/334 |
| 6,834,584 | B1 * | 12/2004 | MacNeil | ..... | 101/333 |
| 6,945,172 | B1 * | 9/2005 | Shih | ..... | 101/333 |

(Continued)

FOREIGN PATENT DOCUMENTS

| | | | | | |
|---|---|---|---|---|---|
| AT | 503827 | * | 1/2008 | ..... | B41K 1/00 |
| DE | 1276662 | B | 9/1968 | | |

(Continued)

*Primary Examiner* — Blake A Tankersley
*Assistant Examiner* — Marissa Ferguson Samreth
(74) *Attorney, Agent, or Firm* — Lerner, David, Littenberg, Krumholz & Mentlik, LLP

(57) ABSTRACT

The invention relates to a stamp comprising a telescoping upper and lower part as well as a printing plate holder pivotally disposed in the lower part to accommodate the stamp plate. A retaining device for a stamp pad is associated with the printing plate holder, and in a rest position the printing plate holder is positioned in the range 80° to 135°, preferably at approximately 90° with respect to a contact area. From this rest position the stamp can be displaced into an operating position to produce a stamped imprint via guide means, whereby the printing plate holder is turned about two guide pins, wherein one guide pin is respectively disposed on a side face of the printing plate holder, and the guide pins simultaneously engage in guide slots in the upper and lower part.

32 Claims, 21 Drawing Sheets

(56) References Cited

U.S. PATENT DOCUMENTS

| | | | | |
|---|---|---|---|---|
| 7,069,852 | B2 * | 7/2006 | Zindl et al. | 101/334 |
| 2011/0277647 | A1 * | 11/2011 | Zindl et al. | 101/334 |

FOREIGN PATENT DOCUMENTS

| | | | | | |
|---|---|---|---|---|---|
| EP | 0249901 | A2 | | 12/1987 | |
| WO | 2011/085828 | | * | 8/2010 | B41K 1/00 |

* cited by examiner

Fig.8
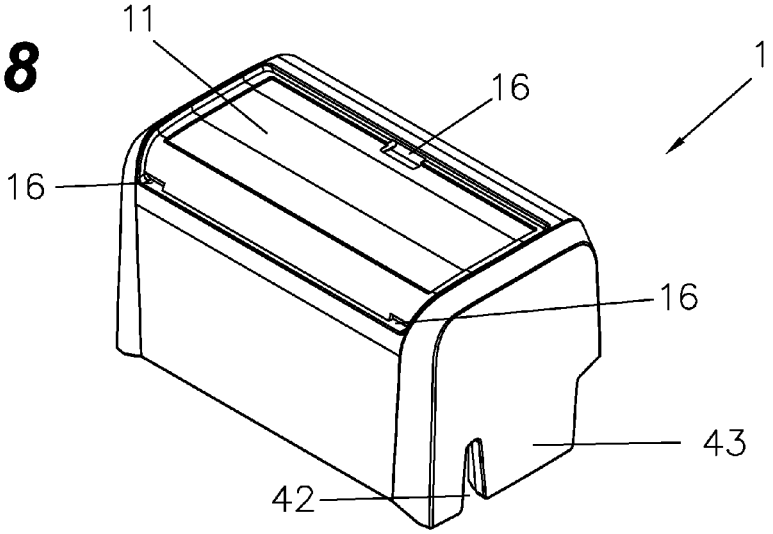
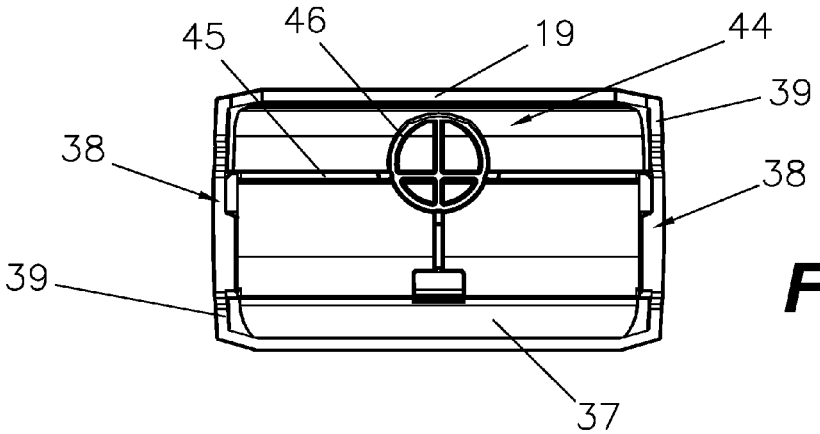
Fig.9
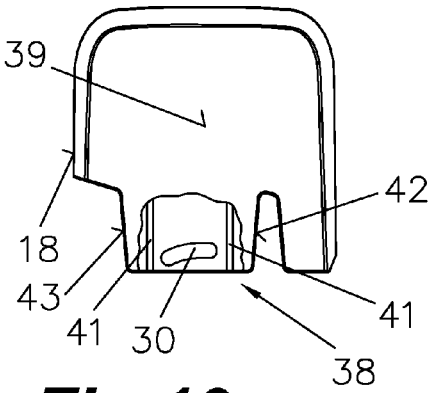
Fig.10
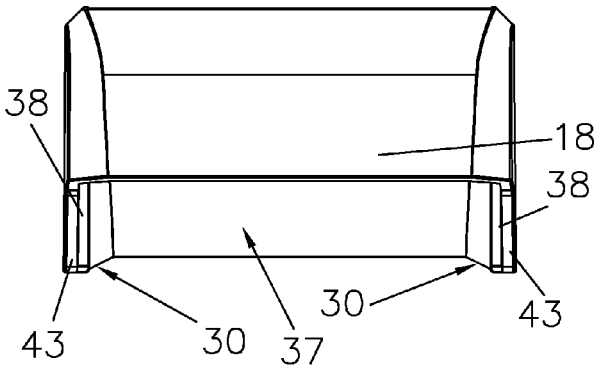
Fig.11

Fig.12
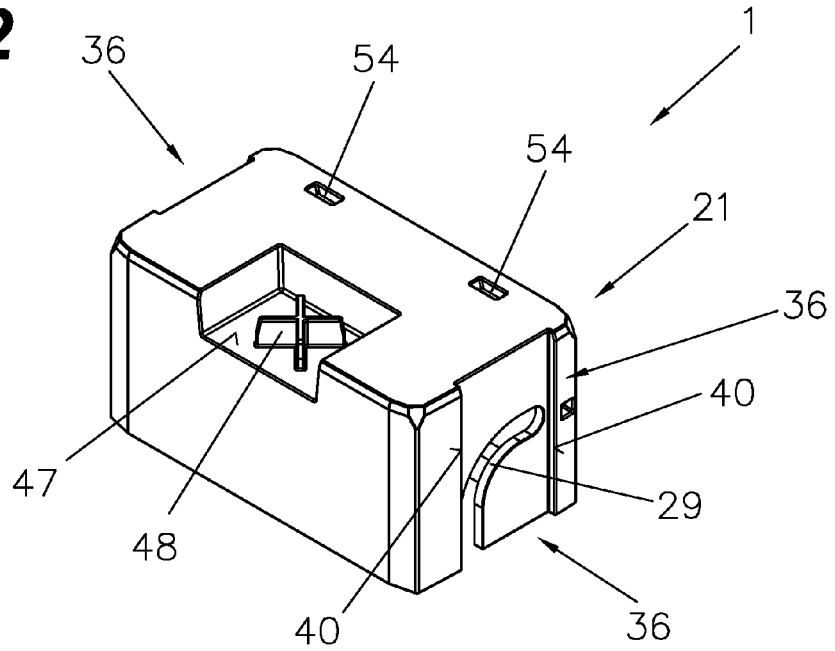
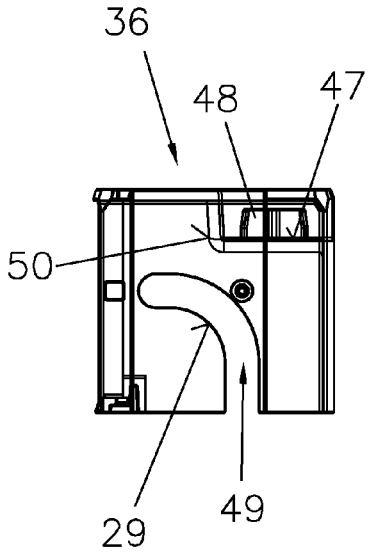
Fig.13
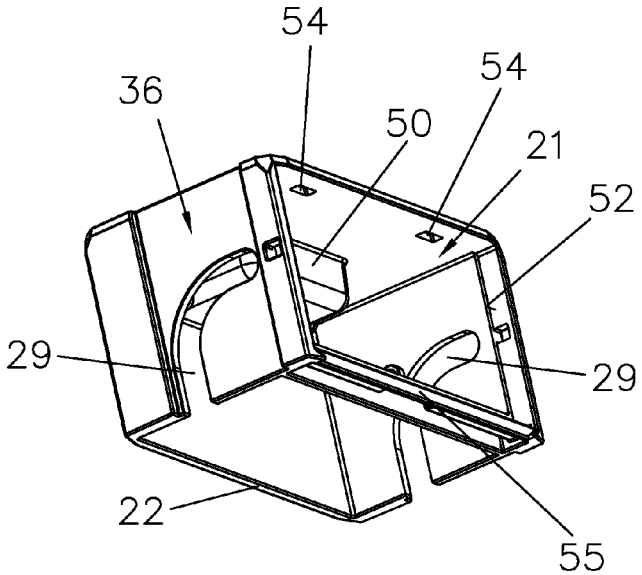
Fig.14

Fig.15
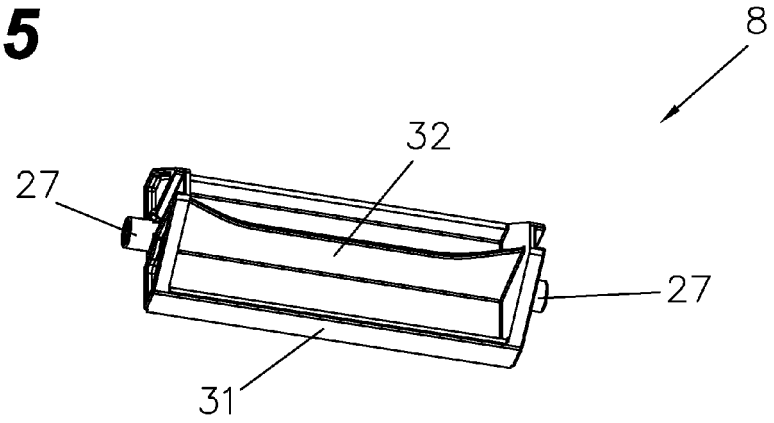
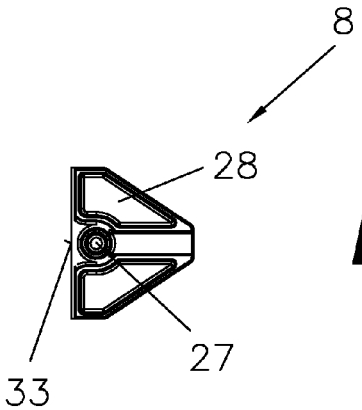
Fig.16
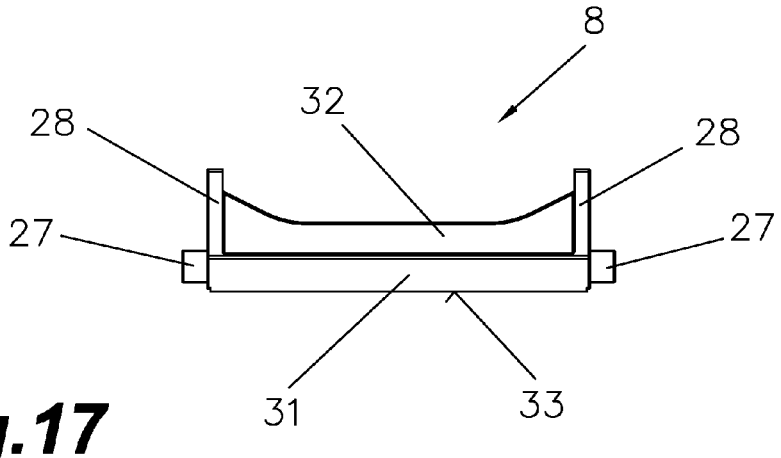
Fig.17

Fig.32
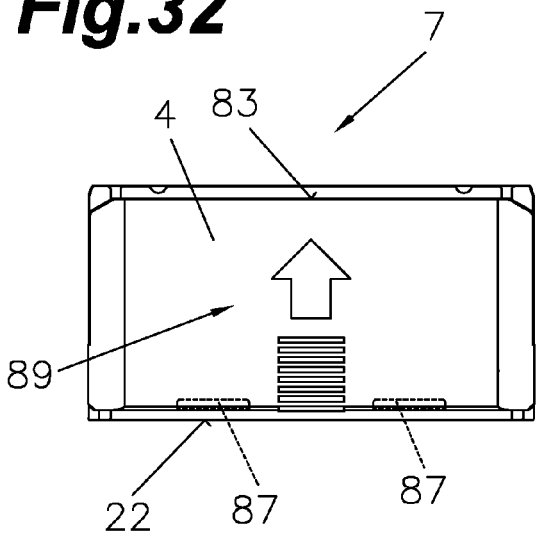
Fig.33
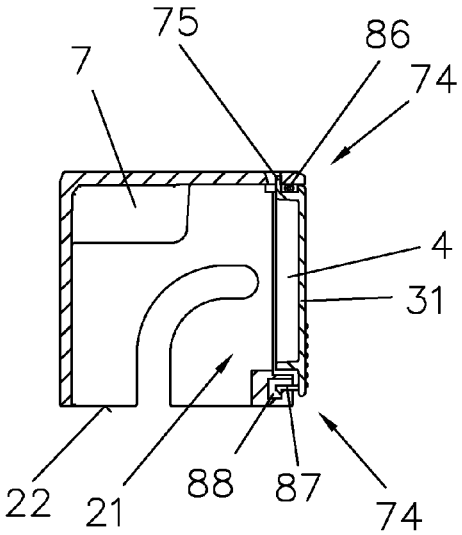
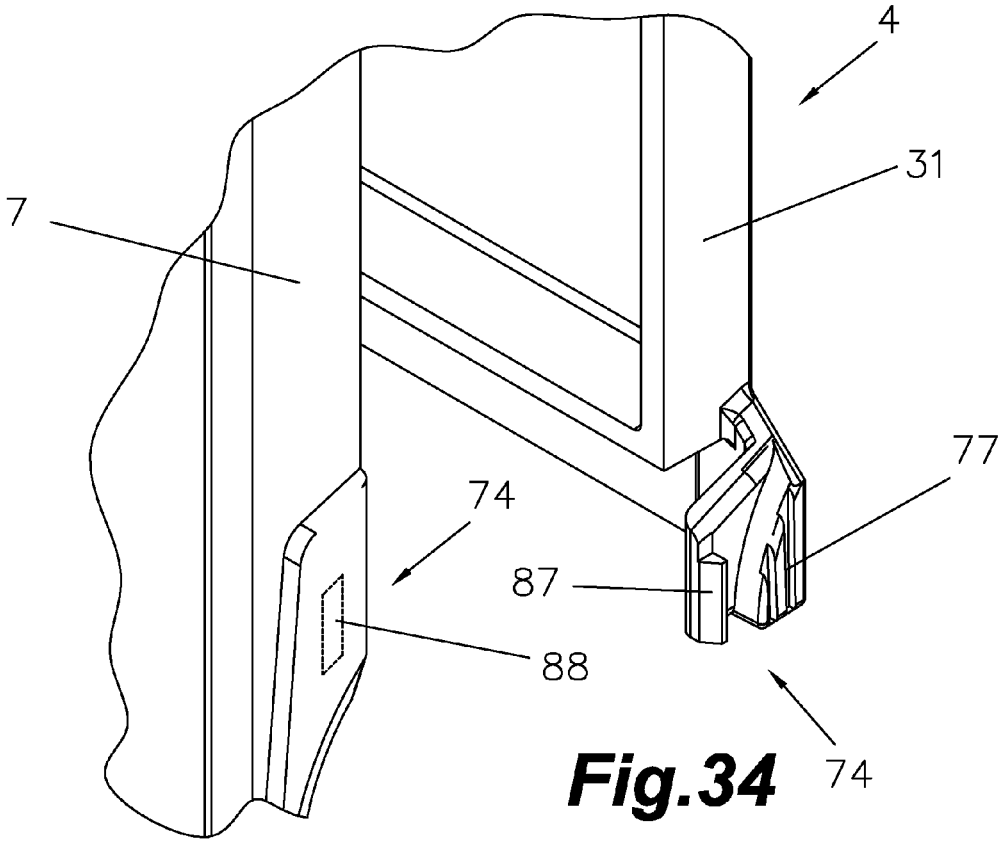
Fig.34

STAMP AND ASSOCIATED STAMP PAD

BACKGROUND OF THE INVENTION

The invention relates to a stamp, a stamp pad and a method for changing a stamp pad in a stamp and for installing a stamp pad.

DE 1 276 662 B describes a self-inking stamp in which in the rest position, the stamp plate is positioned at an angle of 90° to the contact area, in particular a stamping area. Thus, the stamp plate sits close to the stamp pad which is disposed parallel thereto so that it can take up ink. In order to pivot outwards from the rest position to produce a stamped imprint, the printing plate holder on which the stamp plate for the stamped imprint is attached, has two guide pins on each side. Those guide pins are disposed in a T-shaped guide slot, in particular a vertical and horizontal guide slot, in a lower part of the self-inking stamp. Furthermore, the printing plate holder has an axis on which the upper part, with a diagonally orientated guide channel, operates when making a stamping movement. Thus, when stamping, the printing plate holder is initially moved apart from the stamp pad in a horizontal direction by means of the guide channel and the guide slot, and when it reaches the vertical guide slot it initiates a turning movement by vertical displacement of one of the two guide pins in collaboration with the further guide pin in the horizontal guide slot. When the turning movement is complete, or the second guide pin reaches the vertical guide slot, the printing plate holder is then moved along the vertical guide slot to make the stamped imprint.

The disadvantage in that case is that with such a construction of the self-inking stamp, a relatively large amount of effort is required to produce the stamped imprint. A further disadvantage sits in the fact that this type of construction is very large compared to the size of the stamp plate because a plurality of guides and mechanical parts are required, and only a small zone of the contact area can actually be used for printing. In addition, such a construction requires increased force when stamping, since frictional forces arise in the guide axes and the pins. Moreover, it is possible that a smooth motion cannot be obtained because the T-shaped guide slots might cause jamming.

A further similar construction is known from EP 0 249 901 A2 in which again, in the rest position the printing plate holder is at a 90° angle to the contact area at the stamp pad. Again, the turning mechanism involves two guide pins per side, wherein one guide pin is disposed on the lower part and the second guide pin is on the printing plate holder. The guide pin on the lower part engages in a guide track on the printing plate holder, whereas the guide pin on the printing plate holder engages in guide slots on the lower part and upper part. All of the guide tracks are orientated with respect to each other such that the printing plate holder lifts horizontally, pivoting into the vertical position and a vertical motion in order to produce a stamped imprint.

The disadvantage in that case is again that the printing plate holder or the stamp plate can only use a very small region of the contact area since the mechanism of the movement requires a large amount of space to move it apart from the pad and to carry out the pivoting movement.

Furthermore, U.S. Pat. No. 5,740,737 A discloses a stamp in which in the initial position the stamp plate is vertical and an ink-saturated roller is provided to ink the stamp plate rather than the stamp pad. Thus, in the rest position, the stamp plate is either not or is only partially applied to the roller so that only when the stamping procedure begins can vertical displacement of the stamp plate along the roller cause ink to be taken up. The turning movement in this case is initiated by means of a plurality of pins and guides only once the ink has been taken up, i.e. the stamp plate is initially moved vertically at an angle of 90° to the contact area over the roller and then the turn mechanism and stamping procedure is initiated.

The disadvantage in that case is that such a construction does not achieve an optimized, even take-up of ink since in the rest position, the stamp plate does not sit close to the ink-saturated stamp pad. However, if the roller sits partially on the stamp plate, then uneven ink uptake occurs, producing an uneven stamped image.

U.S. Pat. No. 6,834,584 B1 discloses a stamp with a 90° turn to produce a stamped imprint without a stamp pad. In such a stamp, the printing plate holder is constructed such that the stamp plate forms both the stamped image and the ink reservoir. Thus, it is not a self-inking stamp. Since the printing plate holder in such a construction type does not require a stamp pad and thus does not have to be lifted from it and further, it is not necessary to provide space for a stamp pad, or the stamp pad cannot obstruct the turning mechanism, then a simpler pivot mechanism can be constructed with appropriately constructed guide tracks and elements and only one guide pin.

Finally, as disclosed in AT 503 827 B1, for example, a different type of stamp is known having a first housing part, a second housing part that can pivot with respect to the first housing part and a stamp plate which is pivotable from a rest position to a functional position about an axis in a first end zone of the first housing part. In the rest position, the stamp plate is between the first and second housing part and in the functional position, the first housing part forms a triangle with the stamp plate and the second housing part.

The disadvantage in this case is that such stamps are always designed for a single stamping procedure to be carried out and in order to carry out a further stamping procedure, the user manually has to push back the stamp into the rest position so that it can take up ink.

In the prior art described above with what is known as a 90° turn mechanism, the stamp pad has to be changed by pulling the stamp pad downwards out of the contact area of the stamp. Thus, the user has to hold the stamp in one hand and then pull the stamp pad out of a cavity with the other hand. However, since the user has to hold the stamp pad firmly in two fingers in order to pull it out, the stamp pad firstly has to be pushed out of the opening in the cavity, and so changing it is in fact not a simple matter.

A further very clear disadvantage with current stamps is that in the cited prior art of self-inking stamps, in the rest position the stamp plate of the printing plate holder is pressed against the pad of the stamp pad so that it is not possible to simply pull the stamp pad out of the cavity, since it is blocked by the stamp plate. Thus, the user has to push down gently on the stamp so that the printing plate holder is moved slightly in the direction of the stamping position and thus the stamp plate is lifted from the stamp pad so that the user can then pull the stamp plate out. However, the lifted position has to be maintained, meaning that the user has to keep pushing down on the stamp and simultaneously pull the stamp pad out, or the stamp has to be provided with a fixing device by means of which the stamp can be locked in a specific position so that the user no longer has to press down on it and after locking, the stamp pad can be pulled out. Building in such a fixing device considerably adds to expenditure and costs and also further complicates the construction of the stamp.

Thus, it can be stated that user comfort, particularly when changing the stamp pad of current stamps leaves somewhat to be desired and when changing the stamp, the user's fingers frequently get dirty, since they often cannot grip the stamp pad correctly. Simultaneously moving both hands also means that the user cannot get a proper view of the stamp pad and so touching the ink-saturated pad is an easy matter.

BRIEF SUMMARY OF THE INVENTION

The aim of the invention is to provide a stamp, a stamp pad for a stamp and also a method for changing a stamp pad and for installing a stamp plate whereby a simpler, more compact and cheaper construction is obtained which has reduced bulk and weight and which is easier to operate. A further aim is to use as much as possible of the contact area of the stamp for the stamped imprint. A still further aim of the invention is to avoid the disadvantages mentioned in the introduction.

The aims of the invention are achieved by means of a self-inking stamp wherein the printing plate holder is turned via two guide pins, wherein one guide pin is disposed on each side face of the printing plate holder and simultaneously engages in guide slots in the upper part and lower part.

Advantageously, such a construction of a self-inking stamp with only two guide pins, i.e. only one guide axis or only one pivot point, results in compact pivoting of the printing plate holder from the rest position into the operating position and thus a larger portion of the contact area is available to make the stamped imprint. In this manner, a movement profile is produced by the interaction of two guide slots in different components of the stamp so that the space required for the turning movement of the printing plate holder is kept as small as possible. Furthermore, a smoother movement profile is produced when stamping since, in contrast to the prior art, a plurality of axes do not have to be pivoted in different orders and directions. It is becoming more important nowadays to produce more compact, resource-friendly and functional components. Until now, a compact construction such as that obtained with a self-inking stamp with a printing plate holder positioned in the rest position of the stamp between 80° and 135° to the contact area has had to be accompanied by a reduced imprint size compared with the contact area, since it has required more space for the multiple-axis turning mechanism of the printing plate holder. The embodiment of the invention with only one axis provides a fluid pivotal movement simultaneously with a lower material requirement or smaller bulk. Thus, a major portion of the contact area can be used for the stamped imprint.

An embodiment in which the guide slot in the upper part is essentially horizontally orientated is advantageous since this means that a preferred horizontal displacement is produced in a simple manner when operating the stamp. This means that the printing plate holder or the stamp pad is initially lifted from the insert of the stamp pad.

In one embodiment in which the beginning of the guide slot, starting from the rest position, is upwardly inclined, in particular arcuate, operating the stamp advantageously balances the movement of the upper part by the rise of the guide slot, and thus the printing plate holder or the stamp plate executes only a horizontal movement, i.e. the rising guide slot compensates for pushing down on the stamp, which in fact would have produced a corresponding vertical displacement for the printing plate holder.

In an advantageous embodiment, however, the further guide slot is essentially vertically orientated, since this means that a simple vertical movement can be executed.

In an advantageous embodiment, the guide slot in the end zone disposed in the contact area is vertical, meaning that a corresponding specific vertical path is available to produce a stamped image so that sufficient speed and pressure can be built up to produce a good stamped image. In this manner, the quality of the stamped image is substantially improved.

In an embodiment in which the guide slot in the lower part, starting from the rest position, is downwardly inclined and is vertical in the end zone towards the contact area, a harmonious movement profile is advantageously produced thereby by interaction with the further guide slot in the upper part and thus stamping comfort can be improved. In this manner, then, no jams can occur in the profile because all of the guides are curved and no abrupt changes in movement are required.

However, in an advantageous embodiment, a ledge is disposed in the lower part which is constructed as an abutment or stop; this can produce a defined turning movement in a specific direction in a simple, inexpensive manner.

However, advantageously, the front side of the lower part is provided with a retaining device for a stamp pad to be inserted, since this results in increased accessibility, greatly simplifying its use. This also improves operation.

Further advantageous embodiments and advantages can be discerned from the description.

Further aims of the invention are accomplished by means of a self-inking stamp wherein the retaining device for the stamp pad is constructed such that in the rest position of the stamp, the printing plate holder is freely accessible via the front side of the lower part.

The advantage of lateral accessibility is that the stamp pad or the stamp pad carrier can be pushed in or clamped from outside parallel to the printing plate holder, i.e. in a 90° direction onto the printing plate holder. Because the stamp pad does not have to be pushed into the stamp housing via the contact area, for which purpose a part of the contact area would again have to be kept free, the maximum amount of the contact area is made available for the stamped imprint. Furthermore, it is simpler to install the stamp pad via the side face and when the stamp pad is not inserted, in the rest position of the stamp, the text plate can be mounted on the printing plate holder via the side face. In addition, when changing the pad or recharging the pad, the printing plate holder plus stamp plate does not have to be additionally moved apart from the stamp pad using a separate manually operated locking device. Thus, the embodiment of the invention improves handling and provides for better use of the contact area for the stamped imprint. In addition, the material requirement for the stamp housing is reduced because the side face of the lower part of the stamp housing is no longer present. Advantageously again, removing the stamp pad from the printing plate holder in a parallel manner after releasing the stamp pad from the retaining device means that the user can easily grip it firmly and thus does not get dirty fingers. Furthermore, the user does not have to operate the stamp with the other hand or hold it, but can place the stamp in its normal rest position and the stamp pad can simply be removed laterally from the side face. This free accessibility via the side face has a further advantage, namely that when the stamp pad is not inserted, the printing plate holder is freely accessible via the side face. In particular, such an embodiment means that when changing, there is no need for a fixing device to lock the stamp in a specific position, and so the production costs are substantially reduced and the mechanism is considerably simplified. This also dispenses with the need for buttons or knobs on the outside of the stamp.

In a further embodiment, in which the retaining device for insertion of a stamp pad is disposed in the front side of the lower part, the user can advantageously see almost all of the stamp pad from outside, making it is easier to handle when changing the stamp pad, resulting in less contamination.

In an advantageous embodiment, one or more support surfaces are disposed in the retaining device to support or fix a stamp pad; in this manner, in a simple manner, the stamp pad is prevented from falling into the interior of the lower part. Thus, when inserting the stamp pad, the user no longer has to position it carefully.

In a further advantageous embodiment, the retaining device has means for positioning, holding and releasably fixing a stamp pad in order to fasten the stamp pad in the retaining device more securely. In this embodiment of the means, care must be taken that they also can resist pressure as in this embodiment, the direction in which the stamp pad is changed is the same as the load on the printing plate holder or the stamp pad disposed thereon.

In one embodiment in which the means is constructed as a recess and/or projection, precise positioning is achieved in a simple manner. This is important if, for example, multi-coloured stamp pads are inserted. An appropriate arrangement of such means can also prevent the stamp pad from being inserted in the retaining device the wrong way round.

Still more advantageously, a lower border of the front side of the upper part in the rest position is flush with or protrudes only slightly over the upper border of the retaining device. This ensures that the stamp pad is not covered by the upper part and thus can easily be removed. If the upper border of the upper part were to protrude too far over the lower part, then changing the stamp pad in the rest position would no longer be possible.

Advantageously again, the retaining device is constructed for insertion or removal of a stamp pad in the direction opposite to the mounting surface of the printing plate holder in the rest position so as to substantially enhance user-friendliness.

The aims of the invention are also achieved by means of a stamp with the features whereby the retaining device is constructed such that in the rest position of the stamp, the printing plate holder is freely accessible via the upper side of the lower part.

In this case, in such a construction of the stamp, it is advantageously no longer necessary to separate the printing plate holder from the stamp pad when changing the pad, since the stamp pad can be removed or inserted via the outside without additional effort and in the rest position, i.e. via the upper side of the lower part. In this manner, the pad changing operation is simplified. In addition, the material requirement for the stamp housing is reduced because the upper side of the lower part of the stamp housing is missing. With this type of embodiment, a stamp with a mechanism turning between 135° and 225°, in particular approximately 180°, is used, i.e. the printing plate holder executes a complete turn when stamping. Until now, in known prior art stamps the stamp pad has never been able to be changed in the rest position, but they have always had to be locked in a specific position by means of the fixing device that is provided, so that for removal, the stamp plate or the printing plate holder no longer sits on the stamp pad. In the stamp of the invention, the stamp plate sits on the stamp pad, and the stamp pad is simply removed from it in a parallel manner.

In one embodiment in which the retaining device for a stamp pad to be inserted is disposed in the upper side of the lower part, easier accessibility is advantageously achieved. Simultaneously, it is easier to see the stamp pad, enhancing comfort when changing.

Advantageously again, one or more support surfaces to accommodate a stamp pad are arranged in the retaining device; this provides a simple method for disposing the stamp pad at a specific distance, which thus is always the same, from the printing plate holder or from the stamp plate disposed thereon.

Advantageously again, the retaining device is provided with means for positioning, holding and releasably fixing a stamp pad since this means that only matching stamp pads can be inserted, ensuring the high quality of the stamp.

In an embodiment in which the means is formed as a recess and/or projection, an exact position is advantageously established at the same time as being appropriately held or fixed.

Advantageously again, the retaining device is constructed for insertion or removal of a stamp pad in the direction opposite to the mounting surface of the printing plate holder in the rest position since in this manner, when changing, the stamp does not have to be fixed in a specific position since the stamp pad is removed in the direction of the force or pressure that is exerted. Thus, a stamp pad can be changed at any time. This embodiment also means that when constructing a stamp, a fixing device can be dispensed with entirely.

The aims of the invention are, however, also achieved by means of a stamp pad characterized in that a deformable means for fixing in a stamp is disposed on at least one of the side faces of the stamp pad carrier, wherein the means is formed as a stirrup and a projection or recess is formed on the stirrup.

A combination of a deformable means and a positioning element, in particular in the form of recesses and/or protuberances, is advantageous since in this manner, installation is easy when inserting the stamp pad in a stamp and in addition, enables exact positioning of the stamp pad in the stamp housing. Forming the positioning elements as a deformable means ensures that the stamp pad is positioned and held securely against the downward force of the printing plate holder or the stamp plate applied thereto. By disposing several means at different positions on the stamp pad, the stamp pad cannot be inserted the wrong way round. Further, specific stiff means are responsible for positioning in the retaining device with at least one further deformable means being responsible for releasing from the retaining device. This results in secure insertion and changing of the stamp pad with maximum user comfort.

The aim of the invention is also achieved by means of a stamp pad which is provided on at least one of the side faces of the stamp pad carrier with a deformable means for fixing in a stamp and with at least one positioning element, in particular in the form of a recess and/or a projection or protuberance on at least one further side face.

Advantageously, by compressing the deformable means, it is easy to insert or remove the stamp pad into or out of a stamp and when inserting the stamp pad, after releasing the pressure, the stamp pad will be securely held in its position against the force applied by the printing plate holder or the pressure or stamp plate. Essentially, in the embodiment of the invention, the means secures the stamp pad in the retaining device provided for that purpose since a continuous force is exerted on the stamp pad by the printing plate holder or stamp plate, which, however, can be removed parallel thereto, i.e. the pressure is exerted in that direction in which the stamp pad is removed, so that secure fixing is necessary, as otherwise the stamp pad could be pushed out of the retaining device by the printing plate holder. Constructing it as a stirrup has the advantage that in the border zone a support of the stamp pad is reached and the centre of the stirrup can readily be deformed.

In the advantageous variation in which the stirrup is formed as a handle, it is easy to release the stamp pad from the retaining device in a stamp.

Advantageously again, the stirrup is disposed over the entire long side as this means that positioning can be exact, since the stirrup simultaneously acts as a spacer for the retaining device. In this manner, the stamp pad can be turned in the retaining device.

In a further advantageous embodiment, however, on the side opposite to the stirrup, further means are provided for positioning and/or holding in the form of projections and/or recesses, as this ensures that a stamp pad can only be inserted in a specific position in a retaining device.

The aims of the invention are also achieved by means of a method for changing a stamp pad in a stamp, characterized in that in the rest position, the stamp pad is released from its position in the retaining device and then taken out of the retaining device in the direction opposite to the underside of the printing plate holder.

Thus, advantageously, when changing the pad, there is no further need to separate the printing plate holder from the stamp pad and there is no locking position in which the stamp pad is held at a distance from the printing plate holder. Furthermore, when the stamp pad is removed, the method of the invention allows the stamp plate of the stamp to be freely accessible. In addition, the material requirement is small since there is no need to provide a cavity for the stamp pad or the stamp pad carrier, but the stamp pad or the stamp pad carrier replaces the side on which the printing plate holder sits on the stamp housing. Essentially, in the method for changing a stamp pad, the latter no longer has to be pulled out of a cavity, but after releasing it from the retaining device, the stamp pad is simply removed from the printing plate holder parallel thereto. In this manner, the printing plate holder or the stamp plate remains sitting on the stamp pad during removal, meaning that the stamp remains in the rest position. Disposing the retaining device for the stamp pad on the side face also means that user comfort is substantially increased as the user has free access to the major portion of the stamp pad rather than, as known in the prior art, only being able to grip a small portion of the stamp pad, since the major portion of prior art stamp pads are located in the cavity.

The aims of the invention are also achieved by means of a method for installing a stamp plate, characterized in that the stamp plate is installed in the rest position via the retaining device in the lower part and the retaining device is constructed to accommodate a stamp pad and/or a cover plate, which stays in the retaining device when the stamp is operated.

Advantageously, the user no longer has to fix the stamp in a specific position, in particular in the stamping position, but can simply reach the printing plate holder through the opening of the retaining device in the side face, i.e. it is freely accessible via the side face. Thus, the user can simply introduce the stamp plate through the retaining device and fasten it to the mounting plate of the printing plate holder. Since this is all carried out in the rest position, a fixing device for locking the stamp in a specific position can be dispensed with, substantially reducing the costs and bulk of such a stamp.

In a variation in which the retaining device for the stamp pad is constructed such that in the rest position of the stamp, the stamp pad is freely accessible via the front side of the lower part, the changing procedure is advantageously substantially simplified since, in contrast to the case with prior art stamps, the stamp pad does not have to be pulled out of a cavity, and the stamp does not have to be placed in a change position and locked to lift the printing plate holder for changing. In this type of changing procedure, the stamp can simply be left in the rest position since, in spite of the fact that the printing plate holder or stamp plate is sitting on it, the changing procedure can still be carried out.

In a further advantageous embodiment, the retaining device is disposed such that the stamp pad is freely accessible at the upper side of the lower part, since here again the stamp pad can be removed in the rest position with the stamp plate sitting on it.

Finally, in a still further advantageous embodiment, when the stamp pad is not inserted, the printing plate holder or the stamp plate disposed on the printing plate holder is freely accessible via the retaining device, since the user can reach the printing plate holder or the stamp plate in the rest position at any time through the retaining device, increasing user-friendliness on installation or dismantling or during maintenance work.

Furthermore, the aims of the invention are achieved by means of a stamp wherein a retaining device for a stamp pad is disposed on the front side and means for fixing and removing the stamp pad in the direction of the load on the printing plate holder in the rest position are disposed in the retaining device.

Advantageously, this allows for simple and user-friendly removal of the stamp pad since the user can get a very good grasp thereof. In addition, insertion of the stamp pad is substantially simplified. Neither removal nor insertion requires the stamp to be fixed in a specific position. Thus, the construction is simplified by dispensing with a fixing device.

The aim of the invention is also achieved by means of a self-inking stamp in which a resilient means is disposed in the lower part and protrudes into a retaining device for the stamp pad or is almost flush therewith, and at least one further means is disposed on a further side on the lower part for positioning and holding the stamp pad. Using a resilient means 74 advantageously produces a pressure or force on an inserted stamp pad, whereupon it is urged into a specific position. This means that the stamp pad can be positioned or fixed very solidly and stably. In addition, any inaccuracies arising during manufacture or clearances required for snap fitting can be compensated for so that the stamp pad is securely held in the stamp without it being able to slide backwards and forwards in the retaining device. The advantages discussed further above also apply in this case.

In a further advantageous embodiment, the resilient means is formed by a projection and is disposed on an top face of the lower part, whereby when inserting the stamp pad, a force is developed in the direction of the contact area and at the same time sufficient space is available for forming the resilient means.

In an embodiment in which further means, in particular two further recesses, are disposed on a longitudinal web of the lower part, then advantageously, a second fastening location is created for the stamp pad.

In an advantageous embodiment, two further recesses are disposed on the top face for positioning and holding the stamp pad, since this can prevent the stamp pad from falling out.

In a further embodiment, lateral guides are disposed on the lower part which extend from the top face in the direction of the contact area and end at a distance from the contact area; in this manner, insertion of the stamp pad is facilitated.

In one embodiment, a web is advantageously disposed between the lateral guides to seat the stamp pad so that the stamp pad cannot fall into the interior of the lower part.

In an advantageous embodiment, at least on one side, in particular on a lateral guide or on the top face, a projection is disposed which corresponds to a chamfer on a stamp pad, as this is a simple way of preventing another stamp pad from being pushed in and mating locking mechanisms or snap fit connections cannot become engaged.

In a further advantageous embodiment, a cam is disposed on the top face of the lower part for a corresponding recess on the stamp pad and protrudes into the retaining device, thereby again preventing full introduction.

In a still further advantageous embodiment, a ramp for a corresponding opening on the stamp pad is disposed on one or both lateral guides as a simple way of preventing the wrong stamp pads from being fully introduced.

The aim of the invention is also achieved by means of a stamp pad in which at least one means (74) is disposed on the long side face (106) for insertion in a corresponding means (74) in a stamp (1) and on a further side, a further means (74) is disposed for positioning and holding. This means that the stamp pad can advantageously be manufactured in a simple and cost-effective manner and is tightly and firmly held in a stamp. Cost-effective manufacture of a stamp pad is advantageous since stamp pads are expendable parts and thus are frequently replaced.

In a further advantageous embodiment, two projections are disposed on the long side face as means formed for insertion in recesses on the top face of the lower part of the stamp, and wherein on the opposite side another two projections are disposed for insertion in the recesses on the longitudinal web of the lower part of the stamp; using projections means that positioning can be exact and manufacturing costs can again be kept low.

In an advantageous embodiment, the projections opposite the long side face are disposed on a central web or long side face to provide a more secure hold upon insertion into a stamp.

In a further advantageous embodiment, a further long side face is disposed parallel to the central web wherein a space is formed between the central web and the long side face to accommodate the longitudinal web of the stamp in the space. This substantially improves the visual appearance.

In a still further advantageous embodiment, a grasping element is disposed or formed on both short side faces to make the stamp pad easier to manipulate.

In an advantageous embodiment, a chamfer for a corresponding projection is disposed on the stamp on at least one side; this means that full introduction into the retaining device is only possible if the chamfer and the projection match each other. This prevents the wrong pad or stamp pad from being inserted in the retaining device and for the snap fit connections to engage.

In a still further advantageous embodiment, a recess for a corresponding cam on the stamp is disposed on the long side face, again to prevent full insertion if there is not a match.

In a final advantageous embodiment, an opening for a corresponding ramp on the stamp is disposed on one or both short side faces, for the purposes of easy, cheap manufacture. Furthermore, again only a portion of a stamp pad that does not match can be fed into the retaining device, and so the locking mechanisms or snap fit connections cannot become engaged.

It should be noted that specific advantages of the embodiments are applicable to other corresponding or equivalent embodiments.

The invention will be better understood from the accompanying figures which are simplified and diagrammatic in form.

BRIEF DESCRIPTION OF THE DRAWINGS

In the figures:

FIG. 8 shows a perspective view of only the upper part of the self-inking stamp with a viewing window snap fitted thereto;

FIG. 9 shows a view of the interior of the upper part of FIG. 8;

FIG. 10 shows a side view of the upper part of FIG. 8, in partial section to show the guide slot;

FIG. 11 shows a front view of the upper part of FIG. 8;

FIG. 12 shows a perspective view of the lower part of the self-inking stamp;

FIG. 13 shows a side view of the lower part of FIG. 12;

FIG. 14 shows a perspective view of the lower part with the retaining device but with no inserted stamp pad;

FIG. 15 shows a perspective view of the printing plate holder of the self-inking stamp;

FIG. 16 shows a side view of the printing plate holder of FIG. 15 without a stamp plate or printing plate fixed thereto;

FIG. 17 shows a front view of the printing plate holder of FIG. 15;

FIG. 32 shows a front view of a further embodiment of a stamp pad connected with the lower part;

FIG. 33 shows a sectional view of the embodiment of FIG. 32;

FIG. 34 shows a further embodiment of a stamp pad connection in an enlarged, detailed partial view;

DETAILED DESCRIPTION

Figure 2:
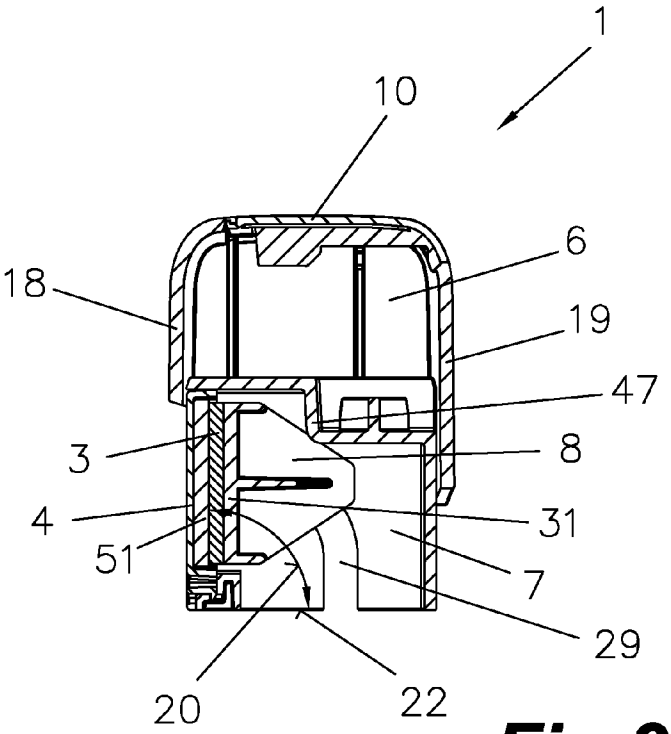
FIG. 2 shows a section through a self-inking stamp in the rest position according to FIG. 1 and with an inserted stamp pad.

Initially it should be pointed out that in the various embodiments described, identical parts are provided with identical reference numerals or the same component descriptions, wherein the disclosure of the whole description can be applied mutatis mutandis to identical parts with identical reference numerals or identical component descriptions. In addition, the positional descriptors in the description, such as top, bottom, side etc., are references to the figure being described and illustrated at that time; they are to be applied mutatis mutandis to the new position when the position is changed. Furthermore, individual features or combinations of features from the various illustrated and described embodiments represent individual inventive solutions.

All details regarding ranges of values in the present description should be understood to comprise any and all partial ranges, for example the range 1 to 10 is understood to comprise all part ranges starting from the lower limit 1 and including the upper limit 10.

Figure 1:
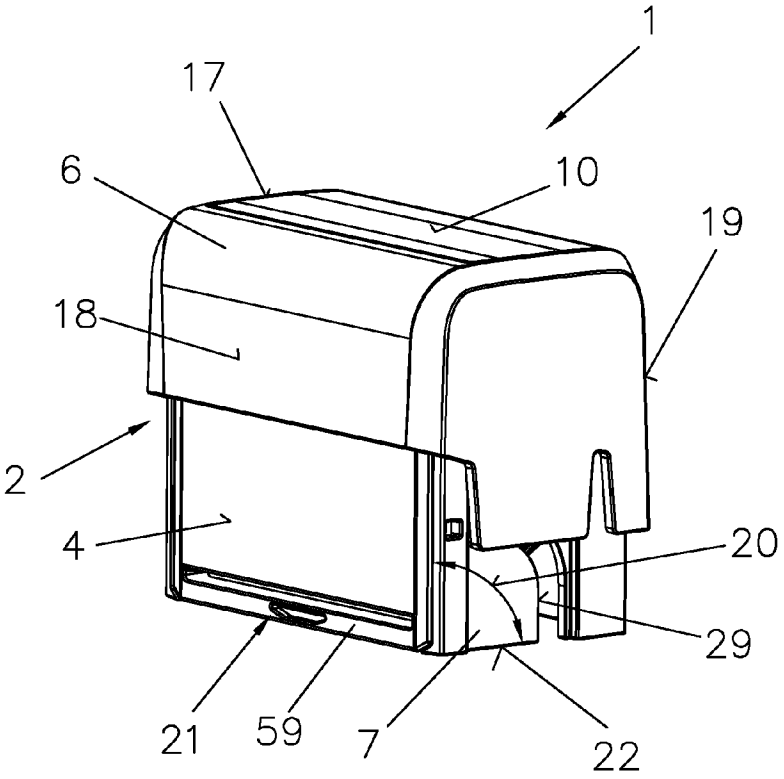
FIG. 1 shows a perspective front view of a self-inking stamp with an inserted stamp pad, in a rest position.
Figure 3:
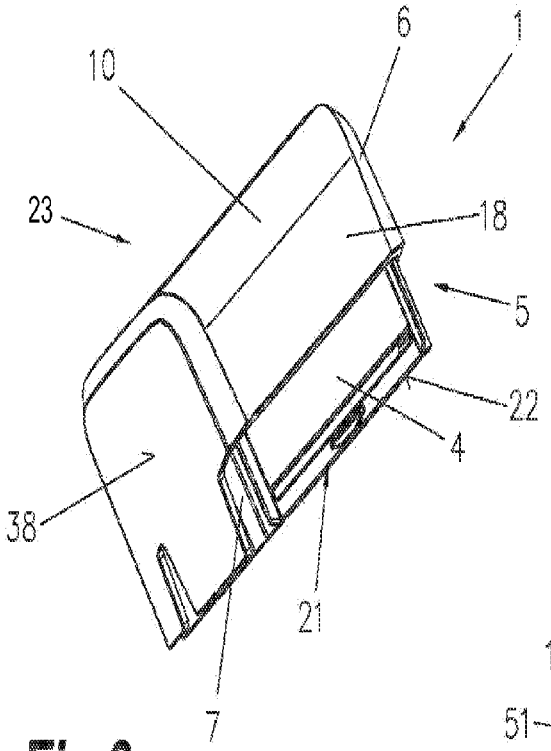
FIG. 3 shows a further, perspective view of the self-inking stamp with inserted stamp pad in the operating or stamping position.
Figure 4:
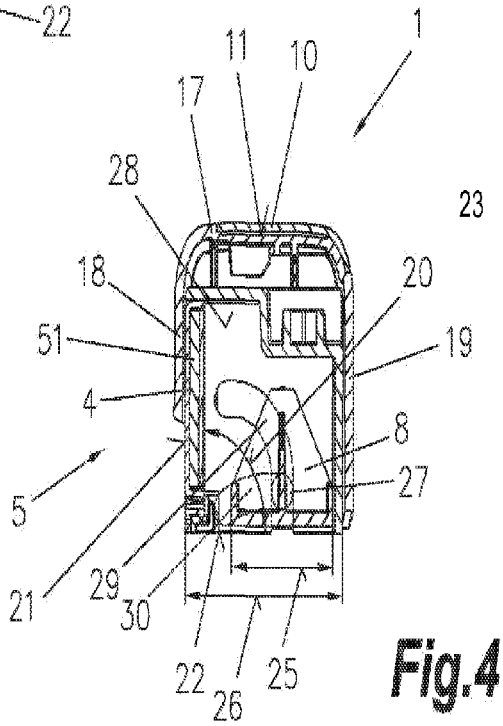
FIG. 4 shows a section through the self-inking stamp in the operating position of FIG. 3, with the guide slots shown in dashed lines to illustrate their interaction.
Figure 6:
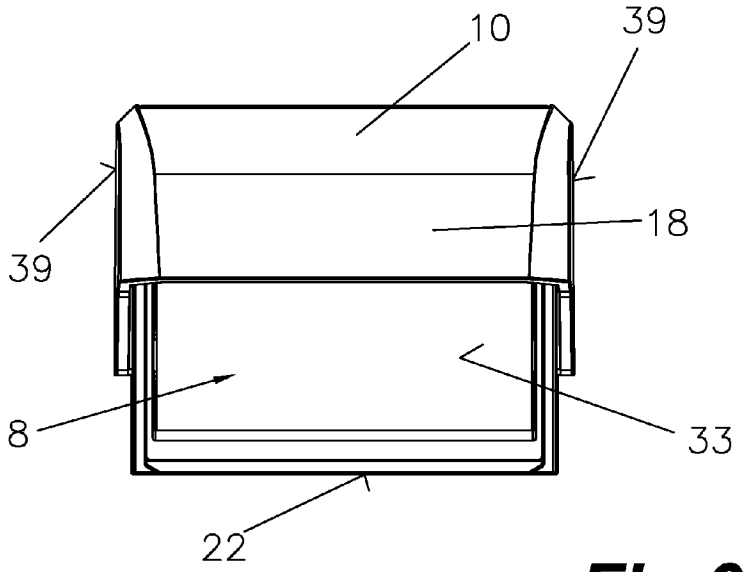
FIG. 6 shows a front view of the self-inking stamp of FIG. 5 in the rest position and without an inserted stamp pad.

FIGS. 1 to 20 show an embodiment of a stamp 1 in the assembled condition and as individual parts; the stamp 1 is what is known as a self-inking stamp 1, i.e. in a rest position 2, as can be seen in FIGS. 1 and 2, for example, a stamp plate 3 takes up ink from a stamp pad 4 and actuation of the stamp 1 into an operating position or actuating position 5, as shown in FIGS. 3 and 4, produces a stamped imprint (not shown) from the stamp plate 3, also termed a printing plate or text plate. It could thus be said that a stamp pad 4 is required in a self-inking stamp 1.

The stamp 1 consists of several individual components, connected simply by being pushed one inside the other without the need for a connecting means such as screws or nuts. Thus, the stamp 1 is assembled as rapidly and simply as possible since the individual parts only have to be pushed one inside the other. Further, the stamp 1 is designed so that only a small number of different parts are required; to produce a stamped image, the stamp 1 is formed from only six different components, so it can be manufactured very cheaply. In order to reduce the cost of such a stamp 1 even further, most components are preferably formed from injection moulded plastic parts. In this case the stamp 1 consists of an upper part 6, a lower part 7, a printing plate holder 8, a spring 9, a stamp plate 3 and the additional stamp pad 4, which usually can be changed and is available as a replacement part.

In order to improve user-friendliness, it is possible to place an insertable and snap-in viewing window 10 in the upper part 6 so that a stamped imprint on paper, foil etc. can be cut to size and then placed between the upper part 6 and the viewing window 10. Since the viewing window 10 is produced from a transparent plastic, the user can see the paper with the stamped imprint behind the viewing window 10. In addition, the upper part 6 is provided with a bay 11 corresponding to the viewing window 10, wherein the long side of the viewing window 10 has two snap-fit elements 12, 13 and the centre of the other parallel long side has a further snap-fit element 14 with a moulded grasping element 15. The snap-fit elements 12 to 14 thus engage in snap depressions 16 in the upper part 6, so that pressing the viewing window 10 on the viewing window 10 onto the upper part 6 results in a snap-fit connection and a more secure hold of the viewing window 10 on the upper part 6. Preferably, the bay 11 for the viewing window 10 in the upper part 6 is formed so that when the viewing window 10 is inserted, the outer surface of the viewing window 10 does not protrude beyond the outer contour of the upper part 6, but lies flush with it. The viewing window 10 is preferably disposed on an upper side 17 of the upper part 6 and can extend into a front side and/or a back side 18, 19. Clearly, the viewing window might be disposed only in the front side and/or the back side 18, 19 of the upper part 6. It is also possible for the viewing window 10 to be fastened on one side to the upper part 6 via an axis of rotation so that on opening the viewing window 10 using the grasping element 15, it can turn via the pivotal axis. This is advantageous when the bay 11 for the viewing window 10 is constructed such that a space (not shown) is created between the viewing window 10 and the floor of the bay 11, in which items can be placed for storage. As an example, the bay 11 may be a few millimeters deep, for example 5 mm, so that stationery items, in particular paperclips, can be stored therein and thus the viewing window 10 has to be opened frequently to remove paperclips; in this case, a rotary axis would be user-friendly. It would also be possible to injection mould or glue a permanent magnet in the bay 11 of the upper part 6 so that paperclips that are placed therein are retained. It is also possible to position a non-transparent cover there instead of a viewing window 10.

In the example shown, a self-inking stamp 1 is shown with a pivot angle 20 for the printing plate holder 8, shown diagrammatically by an arrow in FIG. 1, between 80° and 135°, in particular approximately 90°. This means that a stamp 1 is produced with a stamp pad 4 in which the printing plate holder 8 executes only a quarter-circle movement, wherein the stamp consists essentially of a telescoping upper part and lower part 6, 7 as well as a printing plate holder 8 pivotally mounted in the lower part to accommodate the stamp plate 3, wherein a retaining device 21 for a stamp pad 4 is disposed on the printing plate holder 8 and in a rest position 2 the printing plate holder 8 is positioned in the range 80° to 135°, in particular approximately 90°, to a contact area 22 of the stamp 1 and can be displaced via guide means from this rest position 2 into an operating position 23 to produce a stamped imprint.

Essentially, the turning mechanism for the printing plate holder 8 is constructed such that the printing plate holder 8 has the tightest turning circle in the interior 24 of the lower part 7, thereby optimizing the use of space for a stamping area 25, in order to be able to produce as large a stamped image as possible. To this end, the stamping area 25 which is approximately the size of the printing plate holder 8 is at least 60% larger, preferably in the range 75% to 80%, of the total contact area 26 of the stamp 1. This is accomplished because the printing plate holder 8 is turned via two guide pins 27, wherein one guide pin 27 is disposed on each side face 28 of the printing plate holder 8 and they simultaneously engage in guide slots 29, 30 in the lower part 7 and upper part 6.

Thus, the printing plate holder 8 is constructed so that it has as large a base unit 31 as possible to accommodate as large a stamp plate 3 as possible, and lateral side faces 28 each having a guide pin 27 formed thereon. Further, in the longitudinal direction, the printing plate holder 8 has a central web 32 between the two side faces 28, which supports the two side faces 28 and simultaneously provides good stability. The stamp plate 3 is mounted on the opposite flat mounting surface 33 of the base unit 31 which, when the stamp 1 is assembled, is associated with the stamp pad 4. The length and width of the printing plate holder 8 thus matches the interior 24 of the lower part 7 since it is positioned entirely in the interior 24 and only the guide pins 27 protrude from the interior 24 of the lower part 7. Thus, the base unit 31 is only a few percent, in particular 5%, smaller than the area of the interior 24, so that a very high percentage of the stamping area, at least 60%, preferably in the range 75% to 80% of the contact area 26 of the stamp 1 can be used. The size of the base unit 31 thus depends on the construction of the base unit 31, as it has to be ensured that the printing plate holder 8 can be turned in the interior 24 of the lower part 7 without obstruction. Regarding installation of the stamp plate on the mounting surface 33, it will simply be stated that any fastening method that is known in the art may be used, but preferably the stamp plate 3 is bonded to the mounting surface 33. It is also possible for the base unit 31, in particular the mounting surface 33, to have snap fit indentations, with corresponding snap fit pins on the stamp plate 3, so that the stamp plate 3 is simply pressed and the snap fit pins snap into the snap fit indentations. It is also possible in this regard for the snap fit pins to protrude through the base unit 31.

So that the printing plate holder 8 with the guide pins 27 can be accommodated in the lower part 7, each side face 34 of the lower part 7 has an arcuate guide slot 29 which extends vertically from the contact area 22 and then ends in an arc. In this manner, the arcuate guide slot 29 is formed such that the guide pin 27 disposed on the side faces 28 of the printing plate holder 8 is guided in it with as little play as possible and when assembled, the guide pin 27 points outwards through the guide slot 29 from the interior of the lower part 7, i.e. the interior 24. Since the guide slot 29 extends to the border zone of the side wall 34, assembly simply requires that the printing plate holder 8 is placed in the guide slot 29. However, to allow the guide pin 27 to protrude sufficiently out of the guide slot 29, the entire height 35 of the lower part 7 is recessed or depressed in the region of the arcuate guide slot 29. In this manner, the component is thin, and the guide pin 27 protrudes as much as possible out of the guide slot 29 for further engagement in the other guide slot 30 in the upper part 6, and thus the upper part 6 and the lower part 7 are securely held together via the two guide pins 27, i.e. the upper part 6 and the printing plate holder 8 are connected together, wherein the upper part 6 is simply placed over the guide pins 27 of the printing plate holder 8 and then snap fitted into the guide slot 30 in the upper part. The lower part 7 is simply inserted between the two parts so that then the upper part 6 can be placed over the lower part or the interior can accommodate the printing plate holder 8 which is firmly connected to the upper part 6. To this end, the outer contour of the lower part 7 matches the interior 37 of the upper part 6 so that the lower part 7 can be pushed at least in part into the interior of the upper part 6; the individual parts are preferably rectangular in shape.

The guide zone 36 in the lower part 7 thus serves both as a guide for the upper part 6, for which purpose a vertical guide zone 38 is formed on the side walls 39 in the upper part 6 which corresponds to the guide zone 36, so that the vertical guide zone 38 is positioned and/or guided along the edges 40 of the guide zone 36 over the height 35 of the lower part. The vertical guide zone 38 can thus be constructed as a full-face projection/protuberance, or individual webs can be formed inside the upper part 6, constructed so that they engage in the depression, i.e. into the guide zone 36 and thus are guided over the edges 40. At the same time, the guide slot 30 of the upper part 6 for the guide pins 27 of the printing plate holder 8 is integrated into the vertical guide zone 38, i.e. the vertical guide zone 38 assists in telescoping the upper part 6 and lower part 7 and simultaneously, when telescoped, is responsible for the turning movement of the printing plate holder 8 via the guide slots 30. The guide slot 30 in the upper part 6 is thus disposed such that it initially extends horizontally and then ends in a slight arc in the direction of the lower part 7, i.e. the guide slot 30 is orientated somewhat horizontally and is also responsible for the horizontal displacement of the printing plate holder 8. It could also be said that the guide slot 30 in the upper part 6 is offset by 90° to the guide slot 29 in the lower part 7, i.e. the guide slot 29 in the lower part 7 is primarily responsible for the vertical displacement, whereas the guide slot in the upper part is responsible for the horizontal displacement. What is essential in this case is that the arcuate end of the guide slot 30 in the upper part 6 matches the arcuate end in the lower part 7 so that an appropriate turning mechanism, as described below, can be produced.

To simplify assembly of the individual parts, in the embodiment shown, lateral notches 42 are provided parallel to the vertical guide zone 38, whereas on the opposite side, the side wall 39 and front side 18 of the upper part 6 are broken off, i.e. the side wall 39 and front side 18 are shorter so that when assembled, access is provided to the retaining device 21, since it is no longer or is only partially covered so that insertion of the stamp pad 4 is problem-free. This means that a kind of extension in the vertical guide zone 38 is formed, meaning that when assembling this zone, the extension 43 with the guide slot 30 deforms more easily; in particular, it can be pressed outwards, since less material has to be deformed and thus the upper part 6 can be more easily placed over the guide pins 27 of the printing plate holder 8 for snap fitting in the guide slot 30.

Furthermore, the upper part 6 and lower part 7 each have a spring retaining device 44 onto which the spring 9, in particular a coil spring, is applied and positioned. The spring 9 is present to produce an appropriate force between the upper part and the lower part 7 so that in the rest position 2, i.e. without operating the stamp 1, both parts are always in a defined position with respect to each other and simultaneously the stamp pad 3 is pressed against the stamp pad 4. To this end, the upper part 6 and the lower part 7 are urged apart by the spring 9. Thus, in the embodiment shown, a T-shaped web 45 is formed in the upper part 6, with a central, smaller in height and circular web 46 onto which the spring 9 will be set, so that the spring 9 is positioned between the T-shaped web 45 and the back side 19. Correspondingly, a ledge 47 is provided in the lower part 7 in which an X-shaped web 48 is formed, whereby the X-shaped web 48 corresponds to the diameter of the spring 9 so that it can be pushed over the web 48 and the spring 9 is again positioned and held. Clearly, it is possible to use any manner of fixing the spring 9.

In order to form a ledge 47, the separation and thus the spring deflection between the upper part 6 and lower part 7 are lengthened, so that, for example, a longer spring 9 with a larger pitch can be used for a smaller spring force and thus stamping comfort can be improved, since the user does not have to apply as much force. This also means that the two parts can be pressed closer together, since on pressing together, the spring 9 is accommodated in the ledge 47, i.e. the indentation, so that the upper part 6 can be pressed directly onto the lower part 7. On the other hand, the ledge 47 has the effect of producing, in the interior 49 of the lower part 7, a stop or stop face 50 for the printing plate holder 8 which simultaneously acts as the abutment for introducing the turning movement of the printing plate holder 8.

The turning procedure is as follows: on operating the stamp 1, the upper part 6 is pushed against the spring force of the spring 9 over the lower part 7 and at the same time the guide pins 27 in the guide slots 29, 30 are displaced so that because of the interaction of the guide slots 29, 30, a predefined path for the movement of the printing plate holder 8 is executed; in particular, the printing plate holder 8 is lifted from the stamp pad 4 with an associated turning and vertical movement. In this manner, in the first phase, i.e. at the beginning, the guide pin 27 is initially displaced primarily in a horizontal plane by means of the horizontally orientated guide slot 30 in the upper part 6, whereby the printing plate holder 8 is lifted from the insert 51 of the stamp pad 4, i.e. the displacement in a horizontal plane is the result of the construction of the two guide slots 29, 30, and wherein the printing plate holder 8 is displaced horizontally because of the guide slot 30 in the upper part 6 and simultaneously drops slightly in the direction of the contact area because of the arcuate path of the guide slot 29 in the lower part 7, although the drop in the first phase is only slight. When the upper part is pushed further onto the lower part, i.e. what is known as the second phase is commenced, then the guide pin 27 moves into the arc of the guide slot 29 and because of the guide slots 29, 30, the printing plate holder 8 executes a somewhat circular arcuate movement, whereby the printing plate holder 8 arrives at the ledge 47 in the lower part 7 and bears against it, so that the ledge 47 functions as an abutment and stops the movement of the printing plate holder 8. Since, however, the ledge 47 only partially blocks the movement of the printing plate holder 8, the printing plate holder 8 is now turned or pivoted about the guide pins 27 and thus orientates it parallel to the contact area 22 of the stamp 1. In this manner, the central web 32 also plays a part in the turning movement, since it stops the movement of the printing plate holder 8 in a specific position, i.e. the lower part of the pad holder 31 and the central web 32 are exactly level with the ledge 47 so that overturning is not possible. At the same time, because of the arcuate path of the guide slots 29, the printing plate holder 8 is dropped until it is now positioned below the ledge 47 and on complete telescoping of the upper part 6 onto the lower part 7, i.e. in the third phase, the printing plate holder 8 executes a primarily vertical movement and thus is pushed against the contact area 22 of the stamp 1. In this manner, when a stamp plate 3 is installed, a stamped imprint is produced within the contact area 26, completing the stamping procedure. Next, the upper part 6 is simply released by the user so that it is now automatically lifted from the lower part 7 by the spring 9 and pushed back into the rest position 2. The printing plate holder 8 is now turned in the opposite direction so that it is orientated parallel to the stamp pad 4 and comes to sit on the stamp pad 4 in the rest position 2.

The stamp pad 4 now has to supply ink for a stamping procedure to the stamp plate mounted on the printing plate holder 8, i.e. the stamp pad 4 has an ink-saturated insert 51, as shown diagrammatically in FIG. 4, on which the stamp plate 3 sits with a slight pressure, so that the stamp plate 3 can take up ink from the insert 51 in the rest position. Since, however, the printing plate holder 8 is disposed at a specific angle to the contact area of the stamp 1, it is necessary for the stamp pad 4 to be correspondingly disposed with respect to the printing plate holder 8, i.e. the stamp pad 4 must also be disposed at an angle in the range 80° to 135°, preferably approximately 90° to the contact area 22 of the stamp 1. In this manner, in the rest position 2, the printing plate holder 8 and the stamp pad 4 are orientated parallel to each other, whereby the stamp plate 3 mounted on the printing plate holder 8 is pressed by the printing plate holder 8 with a gentle pressure against the insert 51, i.e. is applied to the stamp pad 4 in the inking direction.

Figure 5:
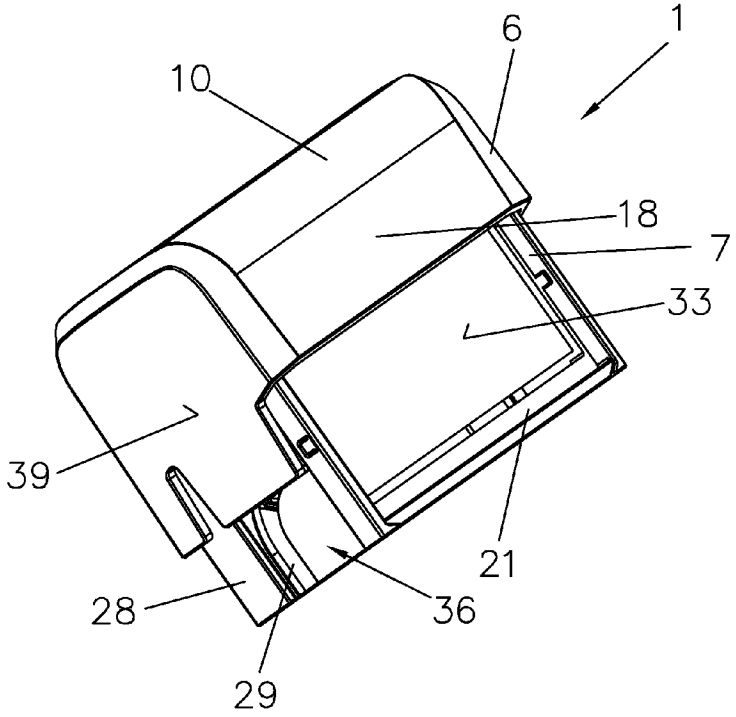
FIG. 5 shows a perspective view of the self-inking stamp without a stamp pad, in its rest position.
Figure 7:
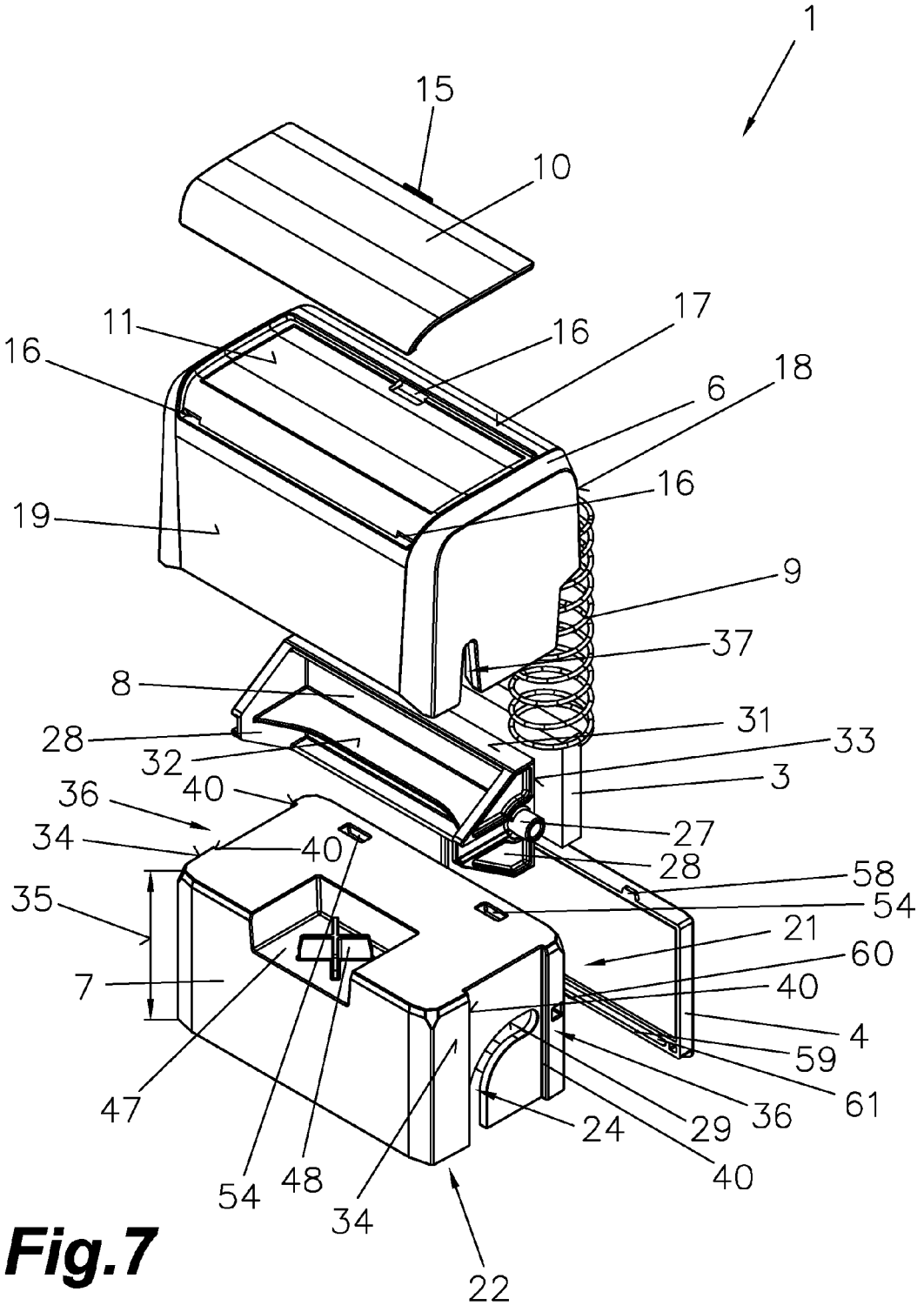
FIG. 7 shows an exploded perspective view of the self-inking stamp.
Figure 18:
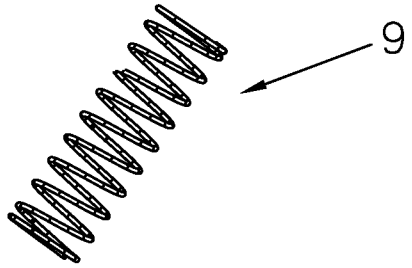
FIG. 18 shows a perspective view of the spring for the self-inking stamp.
Figure 19:
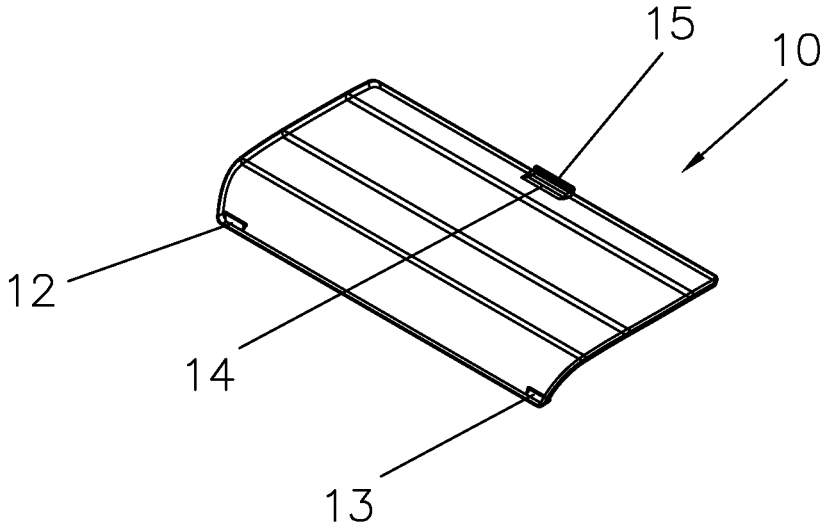
FIG. 19 shows a perspective view of the viewing window for the upper part of the self-inking stamp.
Figure 21:
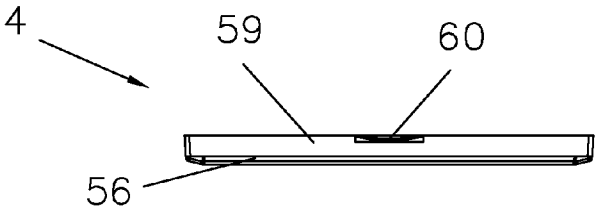
FIG. 21 shows a side view of the long side of the stamp pad of FIG. 20.
Figure 23:
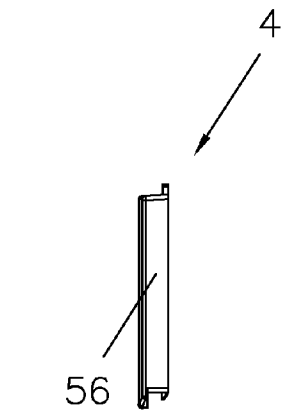
FIG. 23 shows a side view of the narrow side of the stamp pad of FIG. 20.
Figure 22:
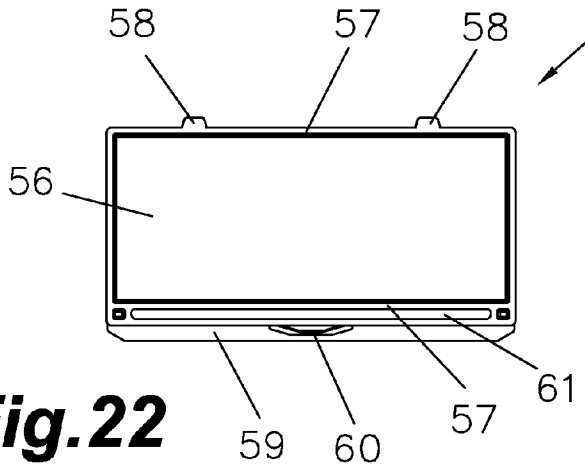
FIG. 22 shows a top view of the stamp pad of FIG. 20.
Figure 24:
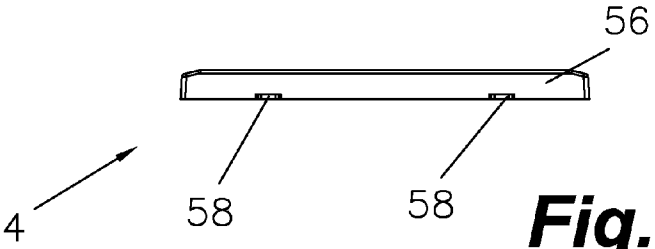
FIG. 24 shows a further side view of the other long side of the stamp pad of FIG. 20.
Figure 20:
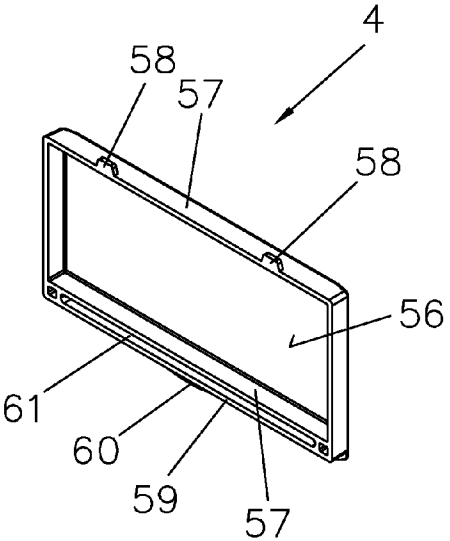
FIG. 20 shows an embodiment of a stamp pad for the self-inking stamp of FIGS. 1 to 19.

Since the printing plate holder 8 is disposed in the lower part 7, the stamp plate 3 is also housed therein. To this end, the retaining device 21 is disposed in the lower part 7 with the stamp pad 4 applied thereto or, when the ink has been applied, removed therefrom, in order to insert a new or freshly ink-saturated stamp pad 4. The retaining device 21 for the stamp pad is thus disposed in the lower part 7 such that in the rest position 2 of the stamp 1 free access is provided to the printing plate holder 8 via the side face of the lower part 7, i.e. when the stamp pad is not inserted, as shown in FIG. 5, the user can reach the printing plate holder 8 directly via or through the retaining device 21 disposed on the front side 34*a* since in the rest position 2 it is orientated parallel to the retaining device 21. However, if the stamp pad 4 is inserted in the retaining device 21, the stamp pad 4 closes off the retaining device 21.

It could thus be said that the retaining device 21 for the stamp pad 4 is disposed on the front side 34*a* of the lower part 7, whereby the retaining device 21 is in the form of a window with means disposed therein to accommodate the stamp pad 4, so that when the stamp pad 4 is not inserted, the printing plate holder 8 disposed inside the lower part 7 and parallel to the retaining device 21 is directly accessible. Since in the rest position 2, a slight pressure is constantly exerted by the printing plate holder 8 against the stamp pad 4, it is necessary for it to be properly held in the retaining device 21 as otherwise, it would be forced thereby out of the retaining device 21 parallel to the printing plate holder 8 and thus out of the lower part 7. To prevent this, the retaining device 21 has means for fastening and positioning and guiding. Correspondingly, such means for positioning, holding and releasably fixing the stamp pad 4 in the retaining device 21 are also disposed on the stamp pad 4.

In constructing the retaining device 21, it is essential that on the one hand it must be ensured that the stamp pad 4 cannot fall into the interior 24 when the stamp 1 is operated; to this end, in the illustrated embodiment, support surfaces 52 are provided in the interior 24 of the lower part 7, in particular on the front side 34*a*, on which the stamp pad 4 sits. Further, recesses 54 and/or projections (not shown) are provided on one long side 53 of the retaining device 21, in particular on the side facing away from the contact area 22. Thus it is possible, and preferable, to use two recesses 54 and/or projections (not shown), which are not disposed symmetrically on the long side 53, so that a stamp pad 4 cannot be inserted in the retaining device 21 the wrong way round. In the centre of the opposite long side 53 is a fastening element 55. It could thus be said that the retaining device 21 is in the form of a window or an opening on which support surfaces 52 are disposed to seat the stamp pad 4 and means, in particular at least one fastening element 55 and one or more recesses 54 and/or projections, are provided for fixing and positioning the stamp pad 4. Clearly, any known prior art solution for fixing and positioning an item may be used; in each case both parts, i.e. the retaining device 21 and the stamp pad 4, would match each other in construction.

The stamp pad 4 correspondingly consists of a stamp pad carrier 56 and an insert 51 disposed therein to accommodate ink, wherein means are provided on the stamp pad carrier 56 for insertion in and/or removal from a stamp 1, in particular the retaining device 21. In the embodiment shown, on at least one of the side faces, in particular a long side 57, of the stamp pad carrier 56 deformable means are provided for fixing in a stamp 1 and on at least one further side face, in particular on the other long side 57, a positioning element is provided, in particular in the form of a recess and/or a projection 58. When the stamp pad 4 is inserted in the retaining device 21, then initially the positioning element, in particular the projection 58, is inserted into the recess 54 and the stamp pad 4 is pushed in its entirety into the retaining device 21, whereupon the deformable means snaps into the fastening element 55. This ensures that the stamp pad 4 cannot be removed from or drop out of the retaining device 21 without operating the deformable means. To this end, the means on the stamp pad 4, in particular the projection 58, are specially constructed to provide a holding pressure for the stamp pad 4 in the retaining device 21. To this end, the means, in particular the projection 58, are tapered, i.e. in the region where they are formed on the stamp pad carrier 56, the material of the means 74, in particular the projection 58, is thicker than at a distance from the stamp pad carrier 56, and thus the means run out at an angle. This means that on inserting the means, i.e. the projection 58, in the recess 54, the force increases with depth of insertion and thus the stamp pad 4 is positioned in the retaining device 21 with very little scope for movement.

The deformable means 74 in the illustrated embodiment is constructed such that the means is in the form of a stirrup 59 and a projection or recess is formed on the stirrup 59, i.e. a stamp pad is produced which consists of a stamp pad carrier and an insert 51 disposed therein to accommodate ink, and means for inserting into and/or removal from a stamp 1 are disposed on the stamp pad carrier, wherein a deformable means for fixing in a stamp 1 are disposed on at least one of the side faces of the stamp pad carrier 56, wherein the means are constructed in the form of a stirrup 59 and a projection 60 or a recess is disposed on the stirrup 59 which is constructed for snap fitting or fastening to the fastening element 55. It is possible to form the stirrup 59 as a handle. In the embodiment shown, the stirrup 59 extends over the whole side face, in particular the long side 57, whereby the stirrup is attached to the stamp pad carrier 56 in the outer border region. It is essential in this case that between the stirrup 59 and the stamp pad carrier 56 a space 61 is provided so that pressure on the stirrup 59 can deform it in the direction of the stamp pad carrier 56 so that the stamp pad 4 can be released from the fastening element 55 or the retaining device 21. Preferably, further positioning and/or holding means are provided on the side opposite to the stirrup 59 in the form of projections 60 and/or recesses.

The particular construction of the stamp pad 4 and the particular arrangement in the front side 34*a* of the lower part 7 means that the changing procedure differs from the prior art procedure. It could be said that a method for changing a stamp pad 4 in a stamp 1 is carried out in which in the rest position 2, a pressure or stamp plate 3 mounted on an underside, in particular a mounting surface 33, of a printing plate holder 8 sits on a stamp pad 4 disposed in a retaining device 21, wherein on operating the stamp 1, the stamp plate 3 is lifted and pivoted from the insert from the rest position 2 into an operating position 5 to produce a stamped imprint, wherein in the rest position 2, the stamp pad 4 is released from its position in the retaining device and then is removed from the retaining device 21 in the opposite direction to the underside of the printing plate holder 8, i.e. there is free access to the stamp pad 4 in the lower part 7 from outside, in particular at the front side 34*a* of the lower part 7, and that the stamp pad 4 is initially released from the retaining device 21 and then is removed from outside parallel to the printing plate holder 8.

Such a simple removal procedure is possible because the stamp pad 4 replaces or fills in a major portion of the side face, in particular front side 34*a* of the lower part 7, as can be seen in the figures.

However, in order to be able to produce a stamped image, it is initially necessary to install a stamp plate 3 since on manufacture, the stamp 1 is only formed from the following parts: upper part 6, lower part 7, printing plate holder 8, and spring 9. The stamp pad 4 is thus designed as a replaceable part and is produced independently of the stamp 1. It is also not necessary for the viewing window 10 to be present. Normally, the user selects a stamp and then decides on a stamped image, preferably using bespoke graphics software. This stamped image is then, for example, transferred to a laser printer to produce the stamp plate 3 from a workpeace. Next, the stamp plate 3 has to be mounted on the printing plate holder 8. In the prior art, this is usually carried out with the stamp 1 in the operating position 5.

In the stamp 1 described, in accordance with the invention it is possible to install the stamp plate 3 in the rest position 2 of the stamp 1, with the stamp plate 3 being guided through the retaining device 21 into the interior 24 of the lower part 7 and then positioned and fastened to the mounting surface 33. It could thus be stated that a method is provided for mounting a pressure plate or stamp plate 3 in a stamp 1, in which in the rest position 2 the stamp plate 3 is disposed in a retaining device 21, wherein on operating the stamp 1, the stamp plate 3 is pivoted from the rest position 2 into an operating position 5 to produce a stamped imprint, wherein the pressure plate 3 is installed in the rest position 2 via the retaining device 21 in the lower part 7 and the retaining device 21 is constructed so as to accommodate a stamp pad 3.

It could in fact be stated that with such a construction of the stamp 1 as described in FIGS. 1 to 20, the stamp pad 4 is disposed on the front side 34*a* of the lower part 7, whereby the stamp pad 4 is removed or inserted into the stamp 1 parallel to the front side 34*a*. Thus, advantageously, the user can gain easy access to the stamp pad 4 and also the major portion of the stamp pad 4 can be seen, so that manipulation when inserting or changing the stamp pad 4 is improved. The dimensions of the stamp 1 are preferably such that the retaining device 21 for the stamp pad 4 takes up almost all of the front side 34*a*, i.e. the height 35 is approximately equal to the narrow side of the stamp pad 4. In this manner, the bulk of such a stamp 1 is substantially reduced, however the space provided for the stamp plate 3 is maximized is approximately the surface area of the stamp pad 4. The upper part 6 is constructed in a corresponding manner, i.e. such that the interior 37 accommodates the lower part 7; in particular, the interior 37 has a height 35 such that the lower part 7 can be positioned in its entirety in the interior 37 of the upper part 6.

Figure 25:
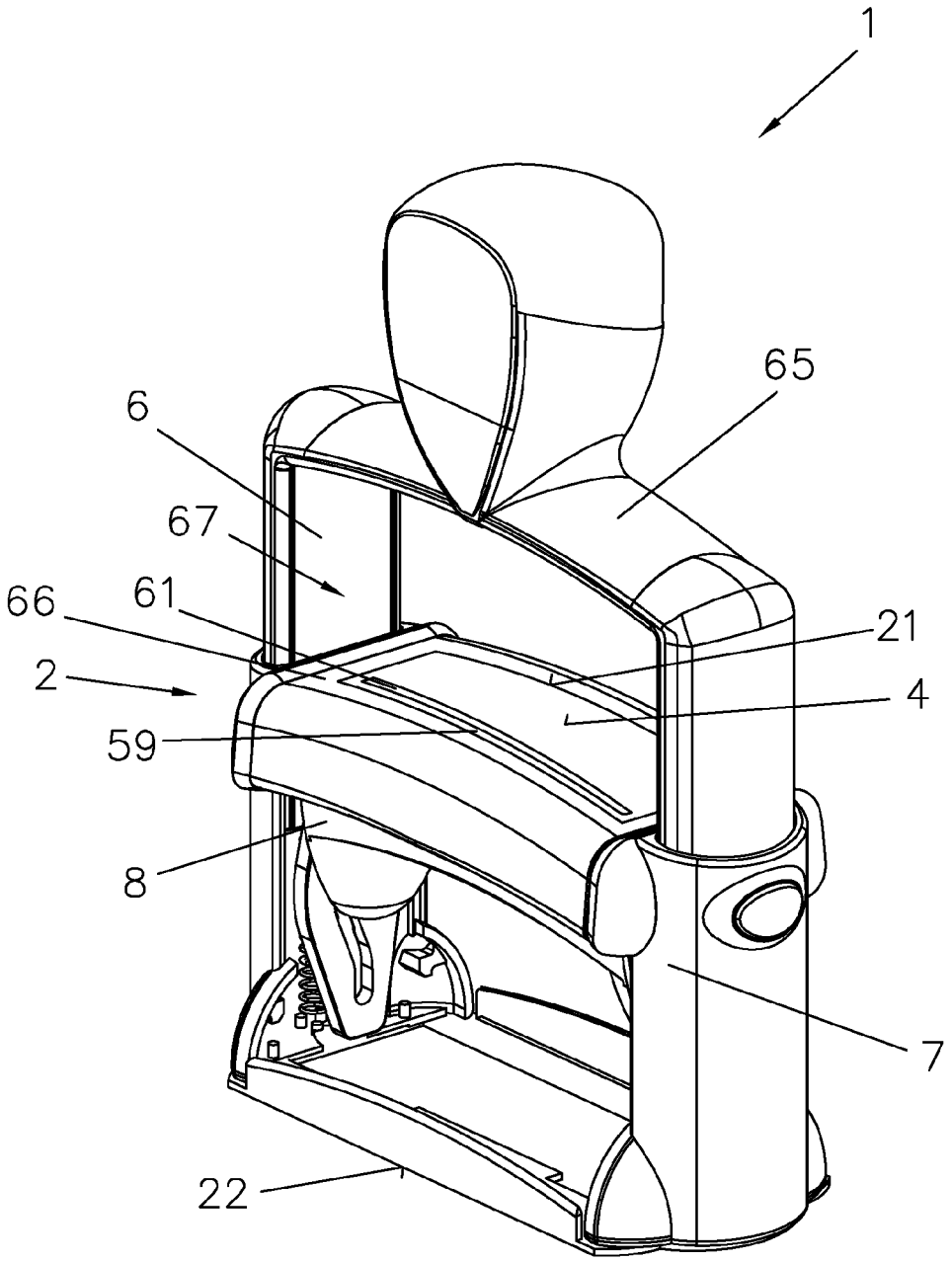
FIG. 25 shows a further embodiment of a self-inking stamp in perspective view showing what is known as a 180° turn mechanism for the printing plate holder.

FIG. 25 shows a further embodiment of a self-inking stamp 1 of a different type. This self-inking stamp 1 has a 180° turner, i.e. the turning mechanism is constructed so that the printing plate holder 8 turns once completely about its axis. Since, however, the individual elements have the same description, the reference numerals that were employed in the figures described above will be used in this embodiment.

The stamp 1 consists of a telescoping upper part 6 and lower part 7 as well as a printing plate holder 8 which can pivot in the lower part 7 to accommodate the stamp plate 3, wherein a retaining device 21 is disposed on the printing plate holder 8 and the printing plate holder 8 in the rest position 2, as shown, is positioned in a region at 180° with respect to a contact area 22, whereby it can be displaced from said rest position 2 into an operating position 23 (not shown) to produce a stamped imprint by means of guide means and the upper part 6 is U-shaped in order to act as an operating stirrup 65, wherein the upper part 6 is distanced from the lower part 7 via the two sides of the U-shaped operating stirrup 65, as is already known from the prior art. However, in order to be able to use the novel stamp pad exchange system as defined in the preceding figures, the lower part 7 has been designed afresh. Here again, the retaining device 21 for the stamp pad 4 is disposed in the lower part 7, whereby the retaining device 21 is constructed such that in the rest position 2 of the stamp, access to the printing plate holder 8 via an upper side 66 of the lower part 7 is free, i.e. the retaining device 21 is disposed under the operating stirrup 65 on the lower part 7 and the user can access the retaining device 21 via the space 67 between the upper side 66 of the lower part 7 and the operating stirrup 65. Directly below and parallel to the retaining device 21 when the stamp 1 is in the rest position 2 is also the printing plate holder 8. This ensures that in the rest position 2, the printing plate holder 8, in particular the stamp plate mounted therein, sits on the insert 51 of the stamp pad 4 when the stamp pad 4 is inserted. However, when the stamp pad 4 is removed from the retaining device 21, it is once again possible to gain access to the printing plate holder 8 via the retaining device 21. This means that the stamp plate 3 can be installed in the rest position 2, as described in the previous embodiment.

It should be noted that in the embodiment shown, the operating stirrup 65 does not have to be provided with a handle element, but may simply be formed by a U-shaped stirrup. It is only necessary to ensure that access to the retaining device 21 is possible between the operating stirrup 65 and the lower part 7, i.e. that there is free access to the retaining device 21.

It can thus be stated that the difference between the two embodiments is that the retaining device 21 for the stamp pad 3 and when a stamp pad 3 is inserted, for the pad per se, on the one hand is disposed on the front side 34*a* of the lower part 7 (90° stamp) and on the other hand is disposed on the upper side 66 of the lower part 7 (180° stamp).

Figure 26:
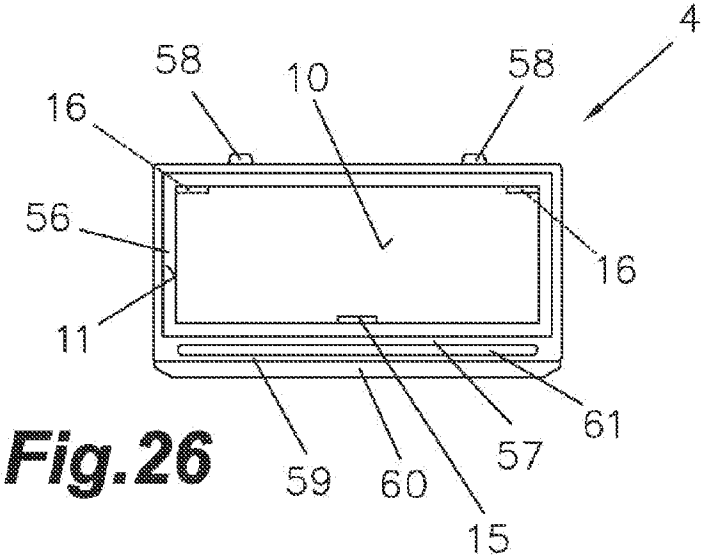
FIG. 26 shows an embodiment of the stamp pad with a viewing window.

It is also possible to provide the stamp pad 4 with a viewing window 10, as shown in FIG. 26 in diagrammatic form, in the manner described above, i.e. the stamp pad carrier 56 has a bay 11 on the opposite side to accommodate the insert 51. This can again be provided with snap fit depressions 16, so that the viewing window 10 with snap fit elements 12 to 14 can be pushed onto the stamp pad 4, in particular onto the back side. In this manner, again a stamped imprint that has already been made can be inserted therein so that it is visible through the transparent viewing window 10. Clearly it is also possible for the arrangement of a viewing window 10 on the stamp pad 4 to be in accordance with the preceding embodiment and the embodiments which are still to be described. Furthermore, it is also possible for the viewing window 10 to be placed on the stamp pad 3 or to surround it. It only needs to be ensured that the stamp pad 4 can be inserted into the retaining device 21.

Figure 27:
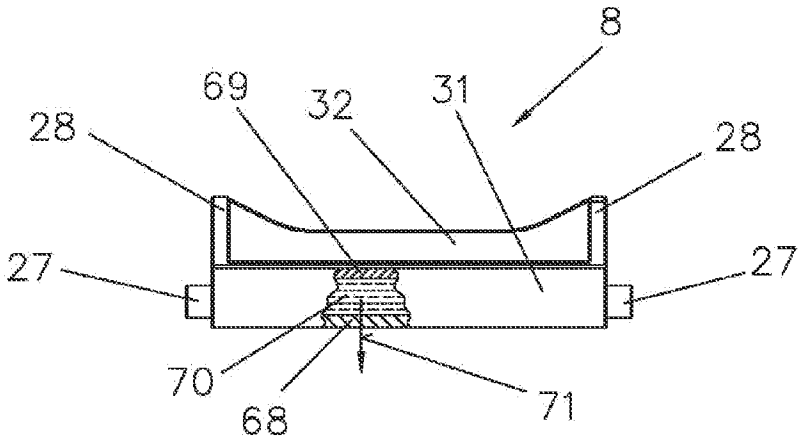
FIG. 27 shows a diagrammatic view of a printing plate holder for a pre-inked stamp.

A further embodiment is shown in FIG. 27. In this instance, however, the stamp 1 is not shown and only the printing plate holder 8 is shown. This printing plate holder 8 essentially corresponds to the construction in the embodiment described above so that it can be inserted in the stamp 1 described above.

In this case, the stamp 1 is essentially formed as a pre-inked stamp 1, wherein the lower part of the pad holder 31 of the printing plate holder 8 is designed to accommodate a pre-inked stamp plate 68, i.e. the lower part of the pad holder 31 has a snap fit frame 69 in which the pre-inked stamp plate 68 is inserted. This means that now no stamp pad 4 is needed, but the stamped image is produced directly from the printing plate holder 8, in particular from the pre-inked stamp plate 68 therein. As is known from prior art pre-inked stamps, the ink is stored in a storage medium 70 in the printing plate holder 8 and from there can trickle out through the pre-inked stamp plate 68, as indicated diagrammatically by the arrow 71. Clearly, it is possible to construct the pre-inked stamp plate itself as a storage medium.

Because a stamp pad 4 is no longer required, a cover plate (not shown) can be inserted in the retaining device 21, whereupon the opening and access to the printing plate holder is closed off. It could thus be stated that the retaining device 21 is constructed to accommodate a stamp pad 3 and/or a cover plate which on operating the stamp 1 remains in the retaining device 21. It is also possible for such a cover plate to be inserted when the stamp 1 is delivered and the user replaces this with a stamp pad 4, in one embodiment with a self-inking stamp 1. In general, it would also be possible for the user to decide whether a self-inking stamp 1 or a pre-inked stamp 1 should be used as only the printing plate holder 8 needs to be changed.

FIGS. 28 to 41 show various embodiments of stamp pads 4 for use in the stamps 1 described above. It should be mentioned here that the retaining device 21 integrated into the stamps 1 are constructed so as to fit the stamp pads 4 shown so that the pad can be inserted in the retaining device 21.

Figure 28:
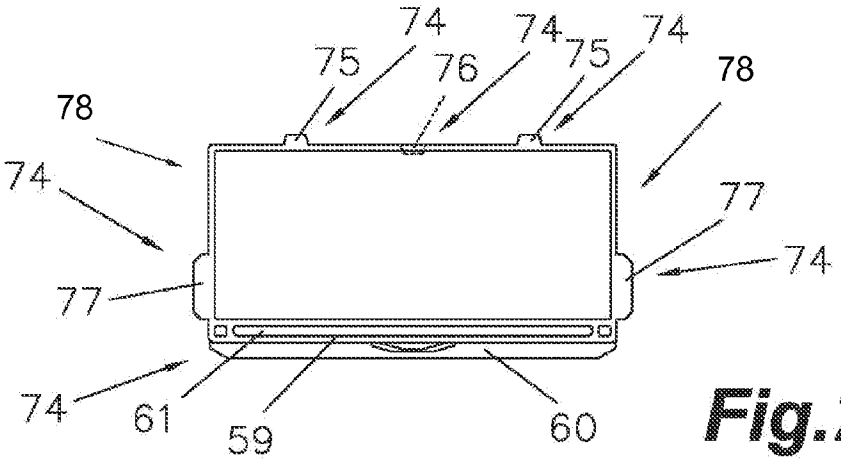
FIG. 28 shows a front view of the stamp pad as an embodiment with gripping elements.

In this regard, FIG. 28 shows an embodiment in which the stirrup 59 is disposed as the means 74 on a long side 57, whereas on the opposite side further means 74, in particular two pins 75 and a pin housing 76, shown as dashed lines, are disposed for similar pins 75 (not shown) on the retaining device 21 of the stamp 1. The pin 75 has a particular form and can, for example, be tapered in shape. The pins 75 may, for example be attachable or removably fastened to the lower part of the pad holder 31 via a snap fit connection, i.e., for example, a guide with or without snap fitting is disposed over the thickness of the base unit so that it can be pushed from one side, in particular from the side where the pad 51 is freely displayed. In this manner, a stamp pad 4, in particular a basic embodiment, can be produced for various stamps 1 with different retaining devices 21, where only the appropriate means 74 have to be applied, i.e., for example, different lengths and/or thicknesses of extensions can be attached.

Additionally in this embodiment, further means 74 are provided in the form of gripping elements 77. They are disposed on the shorter side faces 78 and protrude laterally with respect to the lower part of the pad holder 31. Thus, the user can hold the stamp pad 4 firmly with two fingers by these gripping elements 77 and insert it into the retaining device 21. To this end, in the side regions of the lower part 7, appropriate recesses are provided which, as will be shown in another embodiment, are disposed so that the gripping elements 77 are flush with the outer contour of the lower part 7 or protrude slightly beyond but do not obstruct the course of movement of the stamp 1.

Advantageously, the gripping elements 77 in the region of the stirrup 59 are off-centre, since in this manner the user initially diagonally introduces the stamp 4, with the pins 75 at the front, into the retaining device 21 and then pushes the stamp pad 4 completely in. So that the user has a better grip, it is possible to provide the gripping elements 77 ridges or furrows. It is also possible for them to be removable. In this general regard, it should be mentioned that all of the means 74 illustrated in the embodiments may be removable.

Figure 30:
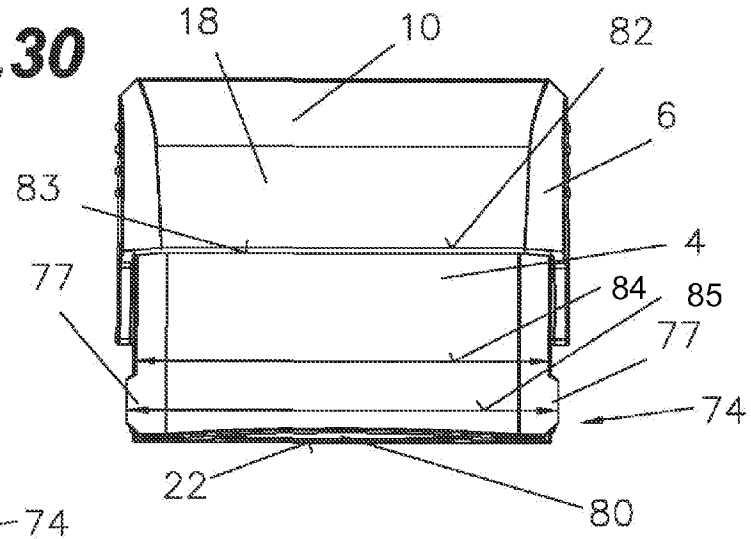
FIG. 30 shows the front view of FIG. 29.
Figure 31:
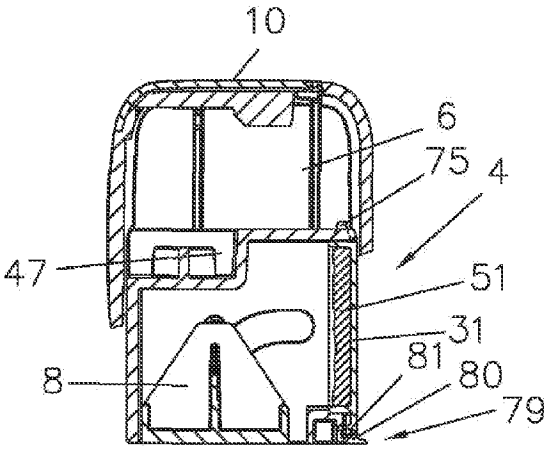
FIG. 31 shows a sectional view of FIG. 29.
Figure 29:
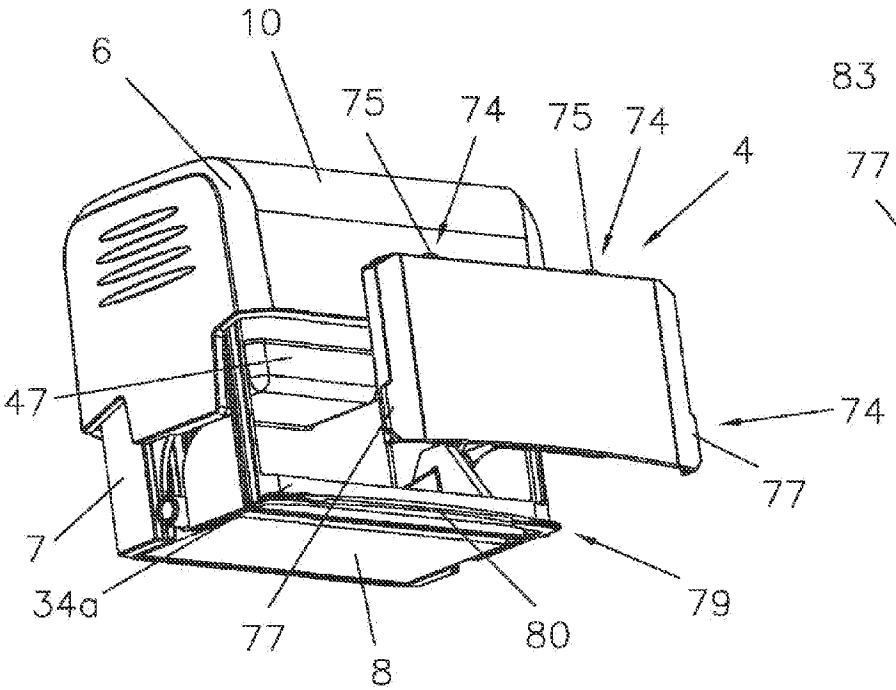
FIG. 29 shows a perspective view of the stamp with a further embodiment of the stamp pad and the associated retaining device.

In a further embodiment such as that illustrated in FIGS. 29 to 31, the stamp pad 4 is constructed so that in this case a particular construction of a locking mechanism 79 is provided to fix the stamp pad 4 in the retaining device 21. To this end, the moveable means 74 are disposed on the retaining device 21, i.e. the stamp pad 4 is provided with only slightly deformable means 74 and to fix it in the retaining device 21 the so-called deformable stirrup 59 is provided with a moveable fixing lip 80. The fixing lip 80 can then be pushed downwards by the user in the direction of the contact area 22, whereby the fixed stamp pad 4 is released and thus the stamp pad 4 can be removed, i.e. by pushing the fixing lip 80 down, a ratchet tab 81 disposed on the stamp pad 4 is released so that the user can hold on to the stamp pad 4 by the gripping elements 77 and pull it out of the retaining device 21. When inserting the stamp pad 4, the mechanism can be designed such that an extension of the fixing lip 80 is actuated by the stamp pad 4, so that the fixing lip folds upwards and locks the stamp pad 4 or the ratchet tab 81, since the fixing lip 80 makes a snap fit connection.

Furthermore, the figure shows that in the rest position 2, a lower border 82 of the front side 18 of the upper part 6 is flush with the upper border or an upper edge 83 of the retaining device 21 or only slightly protrudes beyond it. This occurs because the upper part 6 is appropriately constructed and the front side 18 is shortened so that the stamp pad 4 sits freely in the front side 34*a* and thus can easily be removed. It is also in general possible for the lower border 82 of the front side 18 to protrude slightly beyond the retaining device 21 or the stamp pad 18, but care must in this case be taken that the stamp pad 4 can still be pivoted out easily.

It can also be clearly seen in FIG. 30 that the gripping elements 30 can protrude beyond the side rims of the lower part 7 if appropriately disposed, i.e. if the gripping element 77 in the region of the contact area 22, i.e. the lower region, is disposed appropriately, then the whole width 85 of the gripping element 77 may be longer than a width 84 of the lower part 7 since on operating the stamp 1, the shortened design of the front side 18 means that it again ends in the operating position 5 above the gripping element 77. However, if the gripping element 77 is displaced more into the central region of the stamp pad 4, then the total width is equal to the width 84 of the lower part 7 so that the upper part 6 can be pushed over the gripping element 77.

It should also be noted that in the embodiment illustrated in FIGS. 29 and 30, the stamp 1 is shown in the rest position 2 and the printing plate holder 8 is not yet coupled with the upper part 6 but is only inserted in the lower part 7.

FIGS. 32 and 33 show a variation in which a load and a simultaneous pushing movement unlocks the stamp pad 4, but in this case only the lower part 7 and the stamp pad 4 are shown. It is also possible for unlocking to be carried out without a load.

In this regard in the retaining device 21, in particular in the region of the upper edge 83, means 74 for separating and resilience, known as resilient elements 86, are provided which push an inserted stamp pad 4 in the direction of the contact area 22. As an example, the resilient elements 86 may be formed by simple deformable lugs, brackets or the like, which, however, will always return to the original shape following deformation. In this manner it is possible to provide just one, or a plurality of resilient elements 86. It is also possible for these resilient elements 86 to be formed directly on the stamp pad 4 and on inserting they push the pad in the direction of the contact area 22.

On the opposite side, further means 74 are preferably provided, in particular snap fit extensions 87, which are orientated at 90° to the lower part of the pad holder 31, i.e. in the direction of the lower part 7. These means 74 snap fit into corresponding openings 88 on the lower part 7 or the retaining device 21; the openings 88 are substantially larger than the snap fit extension 87, so that the snap fit extension 87 can be pushed into the openings 88. It is also possible that instead of openings 88 only appropriate snap fit undercuts are provided into which the snap fit extensions 87 can be snap fitted.

In order to release the stamp pad 4, the user initially pushes against the stamp pad 4 in the direction of the lower part 7 and at the same time pushes the stamp pad 4 upwards against the resilient element 86, so that the snap fit extensions 87 in the opening 88 are released from their snap fit connection and the stamp pad 4 can be removed. Preferably, to illustrate the direction for pushing, an arrow symbol 89 is provided on the lower part of the pad holder 31.

FIG. 34 shows an enlarged view of an embodiment in which means 74 are disposed on the gripping elements 77 for snap fitting into the lower part 7. The means 74 are constructed, for example, as a snap fit extension 87.

In general, when designing the stamp pad 4 and the retaining device 21, they can be designed in the reverse manner to that described in the preceding embodiments, i.e. the means 74 of the stamp pad 4 are in the retaining device 21 and the means 74 of the retaining device 21 are disposed on the stamp pad 4. When applying the stamp pad 4, the snap fit extensions 87 engage in the openings 88 on the lower part 7 and thus fix the stamp pad. To release it, both gripping elements 77 now have to be pressed together slightly, releasing the snap fit connection and the stamp pad can be removed, i.e. slight pressure on the gripping elements 77 deforms them slightly and thus the snap fit extensions 87 are pushed out of the opening 88.

Figure 36:
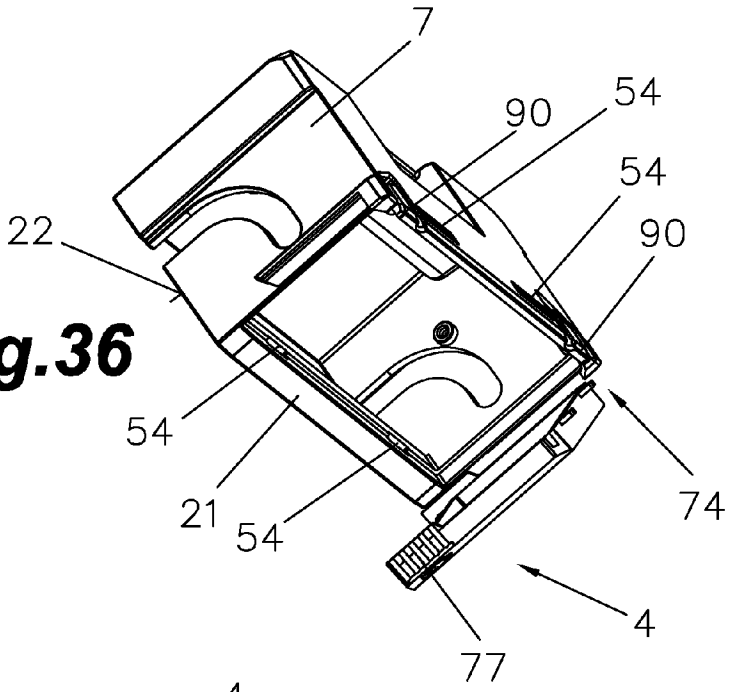
FIG. 36 shows a perspective view of the embodiment of FIG. 35 with the lower part and the stamp pad.
Figure 37:
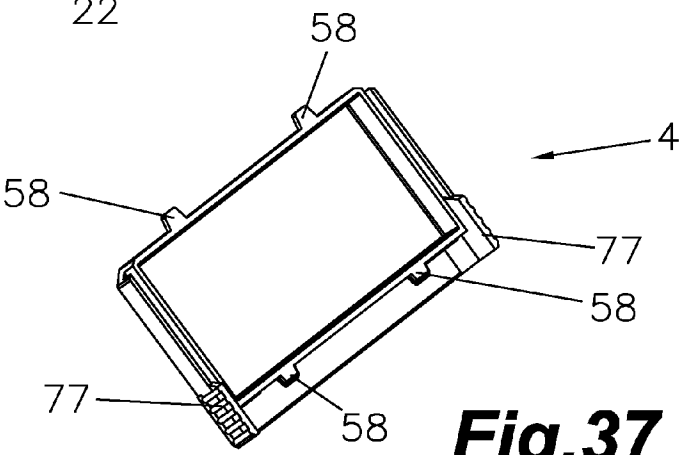
FIG. 37 shows a perspective view of the stamp pad of FIGS. 35 and 36.
Figure 35:
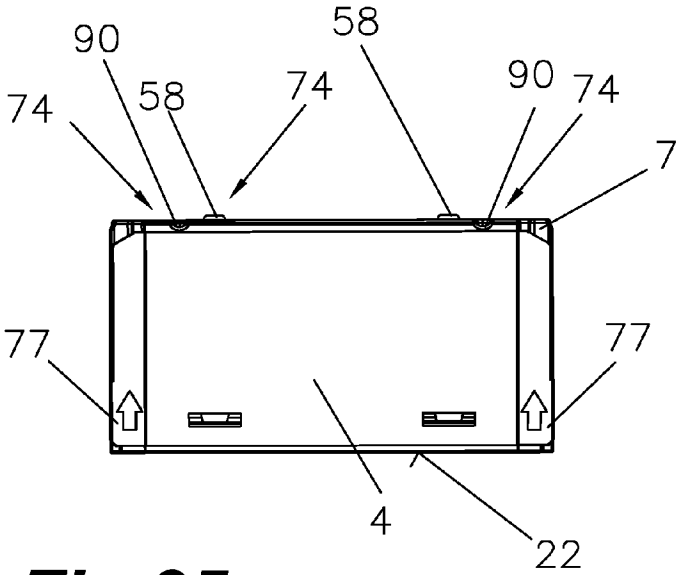
FIG. 35 shows an embodiment with a movable means on the retaining device in the lower part.

FIGS. 35 to 37 show a push mechanism for fastening the stamp pad 4 on the lower part 7, in particular in the retaining device 21. To this end, the retaining device 21 is provided with means 74 which are elastically deformable. They are formed by particular constructions of the border region and thus correspond to a resilient projection 90 which when the stamp pad 4 is inserted, urges it in a specific direction, in particular in the direction of the contact area 22. To attach the stamp pad 4, it also has a plurality, in particular four, projections 58, distributed along the long side 57, i.e. two projections 58 are disposed on each long side 57. Corresponding recesses 54 are disposed in the retaining device 21. When the stamp pad 4 is inserted and removed, the stamp pad 4 is pushed against the resilient projection 90 as indicated by the symbol and then pivoted out or pushed in. With such a construction, again the moveable element or means 74 are disposed on the lower part 7, in particular in the retaining device 21, whereas the stamp pad 4 does not have any deformable elements.

Figure 40:
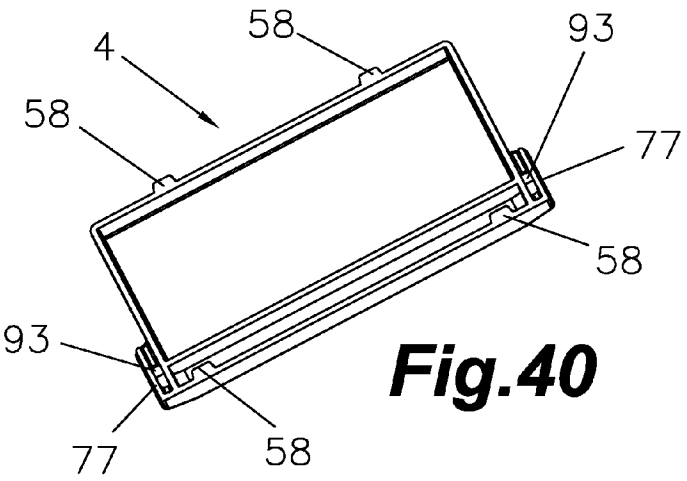
FIG. 40 shows a perspective view of the stamp pad of FIG. 38.
Figure 41:
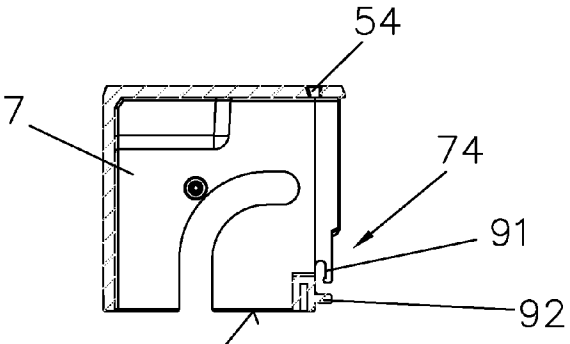
FIG. 41 shows a sectional view of the lower part of FIG. 38.
Figure 38:
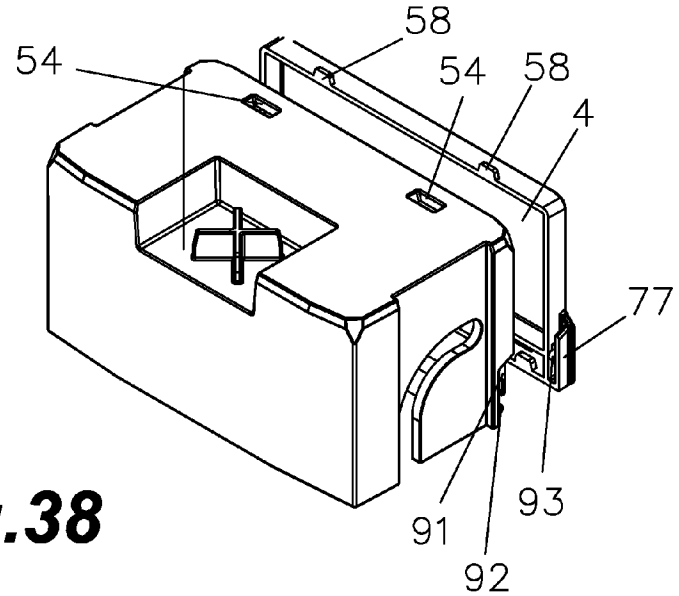
FIG. 38 shows a perspective view of a further embodiment of a stamp pad.
Figure 39:
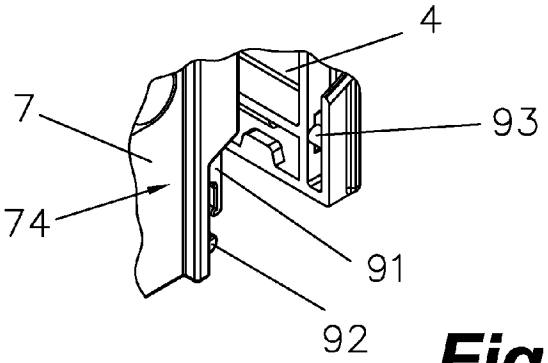
FIG. 39 shows an enlarged detailed view of FIG. 38, in particular the connection mechanism.
Figure 43:
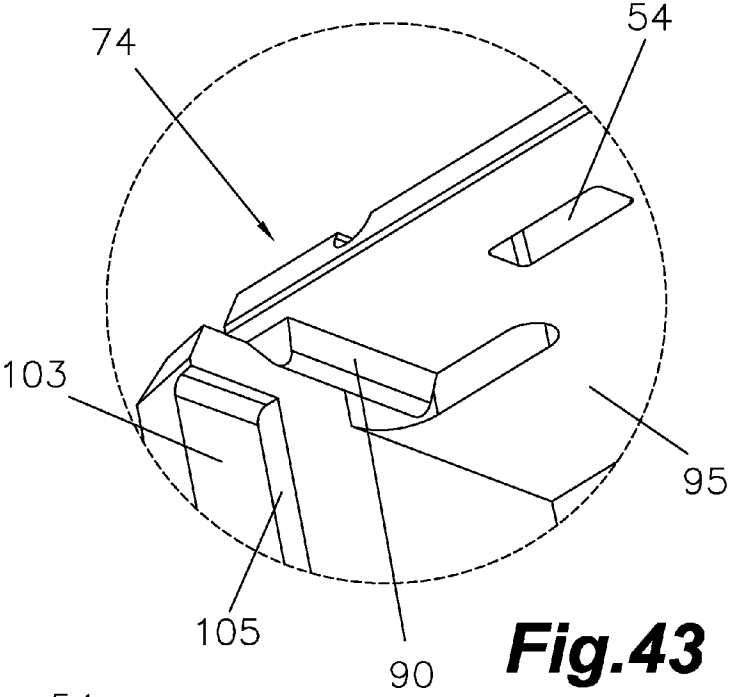
FIG. 43 shows an enlarged view of the resilient means in the lower part of FIG. 42.
Figure 42:
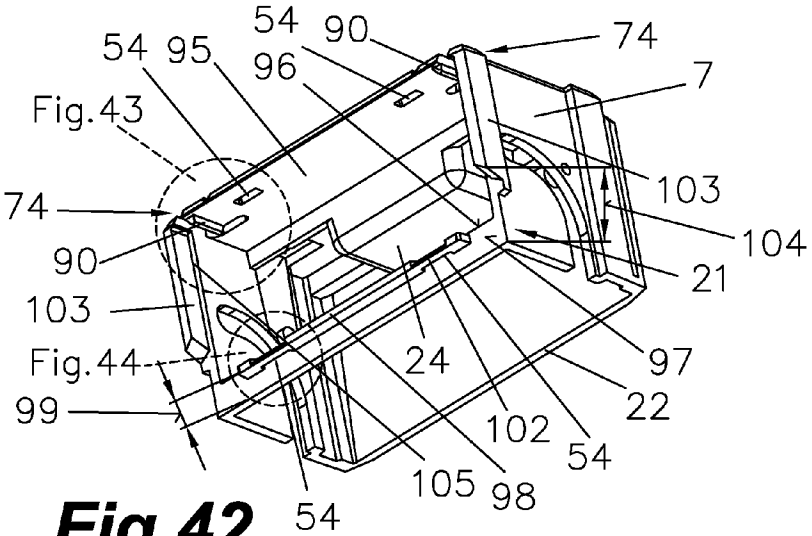
FIG. 42 shows a perspective view of the lower part without a stamp pad.
Figure 44:
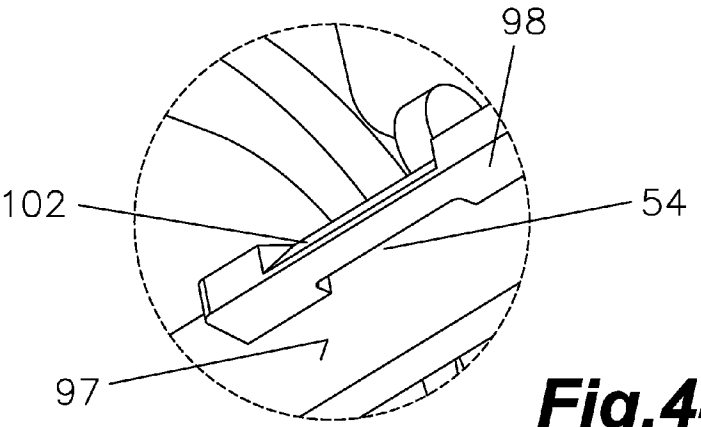
FIG. 44 shows a further enlarged view of a means on the longitudinal web in the lower part of FIG. 42.
Figure 45:
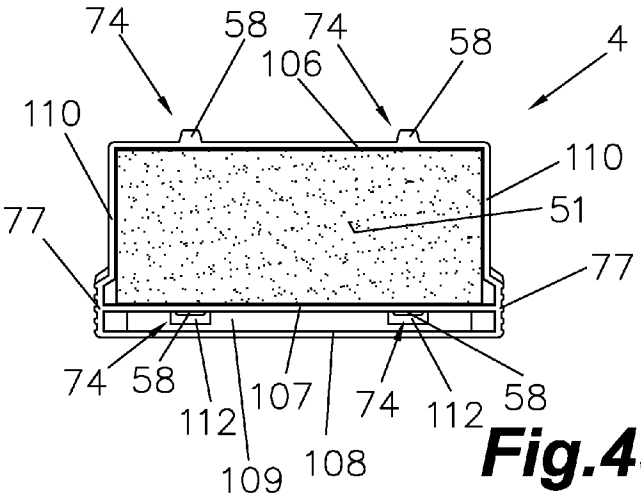
FIG. 45 shows a top view of a stamp pad for integration into a retaining device of the lower part of FIGS. 42 to 44.
Figure 46:
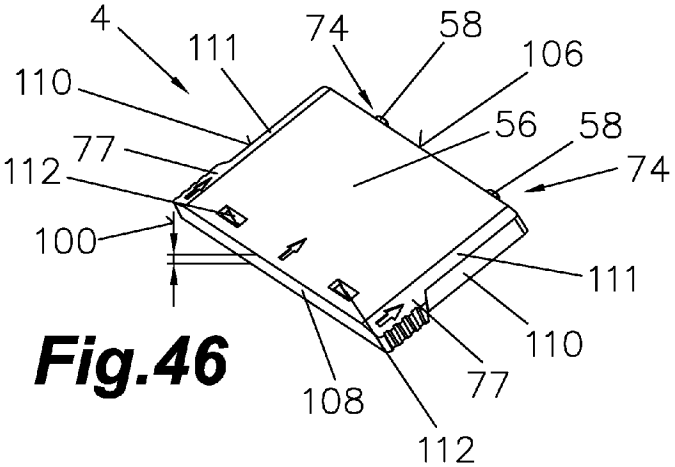
FIG. 46 shows a perspective view of the stamp pad of FIG. 45.
Figure 47:
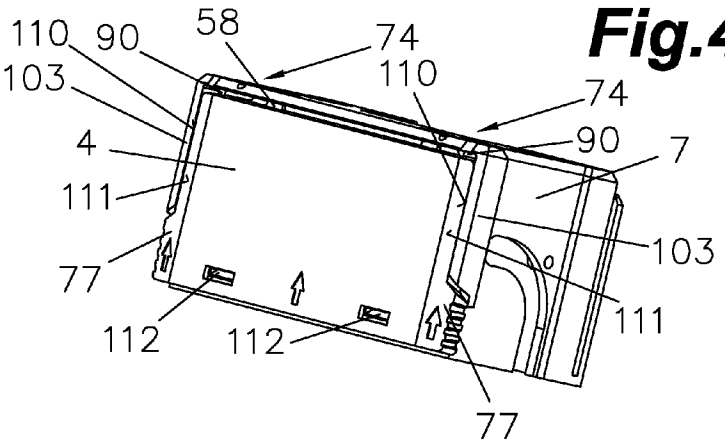
FIG. 47 shows a perspective view of the lower part with an inserted stamp pad in accordance with the embodiment of FIGS. 42 to 46.
Figure 48:
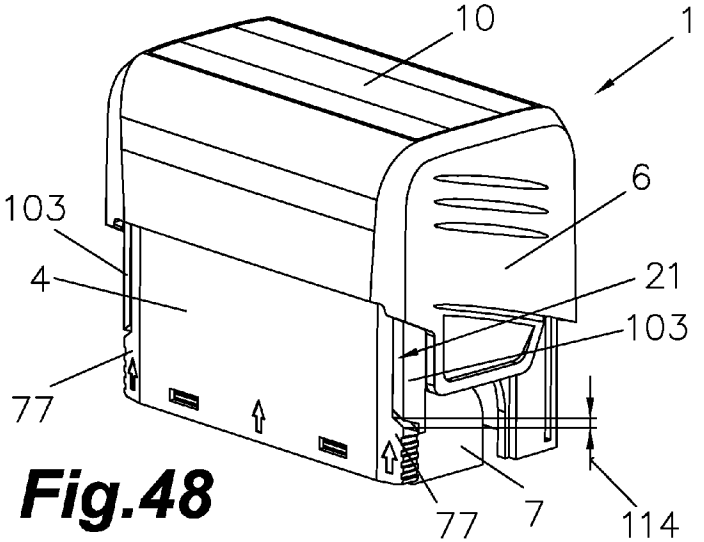
FIG. 48 shows a perspective view of the stamp with an inserted stamp pad in accordance with the embodiment of FIGS. 42 to 47.

FIGS. 38 to 40 show a variation of a connection system for the stamp pad 4 and the retaining device 21. In these figures, the stamp pad 4 is pushed in the direction of the contact area 22 to release it. A suitable symbol is provided to this effect. For attachment, the stamp pad 4 is pushed against this movement.

Attachment is again accomplished via appropriately disposed means 74 provided on the stamp pad 4 and on the retaining device 21. To this end, a snap fit hook 91 is provided on the lower part 7, in particular in the border region near the gripping elements 77 on the retaining device 21. Furthermore, a stop element 92 is provided, against which the stamp pad 4 can be pushed. There is a space between the snap fit hook 91 and the stop element 92 through which a locking element 93 which matches the snap fit hook 91 is disposed.

When the stamp pad 4 is placed in the retaining device 21, then initially, the projections 58 are inserted into the recess 54 and then the locking element 93 is inserted into the space between the snap fit hook 91 and the stop element 92, and then pushed upwards, i.e. against the contact area 22, the snap fit hook 91 is deformed and then snap fits into the locking element 93. To release it, the stamp pad 4 is pushed hard in the direction of the arrow 89 so that the snap fit hook 91 is again deformed and the locking element 93 is released, so that the stamp pad 4 can easily be removed. To improve the positioning, it is also possible to provide projections 58 in the region of the gripping elements 77 so that four-point positioning is provided; in this case, all of the projections 58 protrude in the same direction.

The design of the stamp 1 and/or the individual parts or the stamp pad 4 are appropriate to the embodiments or characteristics described above; this advantageously results in the bulk being approximately 40% smaller when compared with a known prior art stamp with a comparable stamped imprint size. In this manner, advantageously again, the course of movement made by the user is reduced, but the stamped image quality is maintained. Making the stamp smaller also reduces the material requirement and thus reduces the manufacturing costs. Clearly, it is also possible to provide the stamp with a fixing device so that the stamp can be fixed in the rest position 2 and so that the stamp pad can be inserted or removed. In addition, in this manner the stamp pad 4 can be inserted in a fixed position. It could thus be said that this type of stamp 1 can be used where locked or unlocked.

FIGS. 42 to 48 are detailed views of the embodiment shown in FIGS. 35 to 37 wherein parts or functions which are identical to those described for preceding embodiments have identical reference numerals. In this case, the means 74, in particular the resilient projection 90, are shown enlarged in order to make the function of the means 74, in particular the projection 90, more clear. The projection 90 is preferably formed or moulded as a single part from the lower part 7 and the material 95*a* preferably tapers on a top face 95 of the lower part 7, i.e. the projection 90 is disposed on the top face 95 of the lower part formed opposite the contact area 22 and after deforming, the projection 90 deforms again, back into its initial position. The lower part 7 with the resilient projection 90 is thus formed as a single injection moulding.

The retaining device 21 forms a frame-like opening for insertion of the stamp pad 4, whereby a window 96 provides access to the interior 24 of the lower part 7, in particular to the printing plate holder 8. Preferably, the projection 90 is positioned such that it protrudes into the interior of the retaining device 21 or is flush with it so that when the stamp pad is inserted, the resilient projection 90 presses or exerts a pressure on the stamp pad 4 since on insertion, the stamp pad 4 deforms it, i.e. the resilient projection 90 protrudes into the frame-like opening and when the stamp pad 4 is inserted, the stamp pad 4 pushes it backwards, i.e. in the opposite direction to the contact area 22, whereby the resilience of the means 74, in particular the projection 90, exerts a force on the stamp pad 4 and thus the stamp pad 4 is pressed by the projection 90 in the direction of the contact area 22. If the stamp pad 4 is removed from the retaining device 21, then the projection 90 moves back into its initial position and thus protrudes slightly into the frame-like retaining device 21 or is flush with it.

In general, it should be noted that the resilient means 74, in particular the projection 90, can also be formed as an extra part or component and is fastened or positioned on the lower part 7; it is inserted such that when the stamp pad 4 is inserted in the retaining device 21, the means 74 exert a force in the direction of the contact area 22.

Further, two recesses 54 are disposed on the top face 95 so that corresponding projections 58 on the stamp pad 4 can be inserted therein. The projections 58 are intended to position the stamp pad 4 and prevent it from tipping out since the printing plate holder 8 is pressed against the stamp pad 4. The two recesses 54 are, for example, disposed between the two projections 90; in the embodiment shown, the two projections 90 are disposed on the top face in the region of the side faces 34. Clearly, it is possible for only a single projection 90 and/or recess 54 rather than two projections 90 and/or recesses 54 to be provided, preferably disposed in the central region of the retaining device 21, or for more than two projections 90 and/or recesses 54 to be provided. Essentially, the projection 90 is formed such that it can produce a force in the direction of the contact area 22 when the stamp pad 4 is being inserted or when the stamp pad 4 has been inserted, it is pressed by the projection 90 in the direction of the contact area 22 and the recess 54 is constructed so as to accommodate means, in particular projections 58, on the stamp pad 4.

In general, it is possible, however, for the resilient projections 90 to be disposed on the opposite side in the region of the contact area 22; again, they protrude into the interior of the retaining device 21 or are nearly flush therewith. In such an embodiment, the projections 90 now act to push the stamp pad 4 in a direction towards the top face 95, i.e. against the direction described above. However, since only a little space is available in the region of the contact area 22, the embodiment described above in which the projections 90 are positioned on the top face 95 is preferably employed. A combination of the various positions would also be possible.

In order to prevent the stamp pad 4 from falling out of the retaining device 21, in such an embodiment, it is necessary to provide further means for fixing the stamp pad 4 on the retaining device 21 and/or the stamp pad 4. To this end, a longitudinal web 98 is disposed on a supporting surface 97 for the stamp pad in the region of the contact area; again, two recesses 54 are arranged on the longitudinal web. The longitudinal web 98 is preferably disposed close to the opening or window 96 of the retaining device 21 so that an appropriate distance 99 is maintained or exists from the contact area 22, i.e. the retaining device 21, in particular the window 96 of the retaining device 21, does not extend to the contact area 22 but is smaller or set back by the distance 99. This is necessary because in the region of the contact area 22, when inserting the stamp pad 4, it must be ensured that the projections 58 on the stamp pad 4 in this region do not protrude into the contact area 22 when they are inserted into the recesses 54 on the longitudinal web 98.

Thus, the lower part 7 with the retaining device 21 is constructed such that it matches the special stamp pad 4 and thus can accommodate it. Care should be taken that all of the parts or components are appropriately provided and installed, so that they can be accommodated in the interior of the upper part 6 when stamping. For this purpose in the embodiment shown, the external contour of the top face 95 of the lower part 7 is a maximum and none of the parts can protrude beyond it. Thus, the supporting surface 97 in the region of the contact area 22 is set back by the thickness 100 of the stamp pad 4 and can thus accommodate the stamp pad 4, i.e. the stamp pad 4 can sit on the supporting surface 97. At least part of the length of the longitudinal web 98 is disposed on this supporting surface 97 and protrudes in the direction opposite to the interior 24. Thus, the longitudinal web 98 is preferably smaller than the thickness 100 of the stamp pad 4, so that when inserting the stamp pad 4, the longitudinal web 98 is accommodated in the stamp pad 4, i.e. a recess or space 109 is provided in the stamp pad 4 into which the longitudinal web 98 protrudes when the stamp pad 4 has been inserted or the stamp pad 4 is constructed such that the stamp pad 4 can be disposed between the top face 95 and the longitudinal web 98, whereupon the longitudinal web 98 forms a flush element or the stamp pad 4 only partly protrudes over the longitudinal web 98, i.e. the stamp pad 4 is only disposed between the top face 95 and the longitudinal web 98 or the stamp pad 4 protrudes only over part of the length of the longitudinal web 98.

As mentioned above, the two recesses 54 on the longitudinal web 98 are designed for the corresponding projections 58 of the stamp pad 4. Preferably, in each region of the recesses 54, a surface 102 provided on the longitudinal web is tapered in the direction of the opening of the retaining device 21, so that when the stamp pad is inserted, the projection 58 is more easily guided in the direction of the recess 54 over the surface 102 so that insertion of the stamp pad 4 is substantially facilitated, since the projections 58 can easily slide or be pushed over the inclined surface 102 into the recess 54.

In order to guide the stamp pad 4 to be inserted, a lateral guide 103 is provided in the lower part 7. The lateral guide 103 extends from the top face 95 in the direction of the contact area 22 and ends at a specific distance 104 from the contact area 22, with the distance 104 being such that it can accommodate a grasping element 77 of the stamp pad 4, i.e. the stamp pad 4 is formed such that in this region grasping elements 77 are disposed on both sides and extend from the inside of the lateral guide to the outside and are flush with the outside. It is advantageous in this case, when the stamp pad 4 has been inserted, to leave a certain gap 114 between the grasping elements 77 and the lateral guides 103 so that on removal, pressure on the stamp pad 4 in the direction of the top face 95 of the lower part 7 can push the stamp pad 4 in the direction of the top face 95, whereupon the projections 58 are moved out of the recesses 54 in the longitudinal web and thus, as is preferred, the stamp pad 4 can be removed with a slight turning movement.

Further, between the lateral guides 103 a web 105 is disposed to seat the stamp pad 4 so that the stamp pad 4 cannot fall into the interior of the lower part 7. To this end, the web 105 and the supporting surface 97 form a plane so that it could be said that the supporting surface 97 extends along the web 105. The supporting surface 97 or web 105 in the region of the lateral guide 103 forms only a very narrow web 105 in order to create as large an opening or window 96 as possible for the retaining device 21. However, the web 105 should be wide enough to ensure that the stamp pad 4 is guided onto said web 105 when the stamp pad 4 is inserted but substantially, the stamp pad 4 is prevented from falling into the interior of the lower part.=

It could thus be said that the embodiment shown illustrates a special construction of the lower part 7 with the associated specially constructed stamp pad 4, wherein the resilient means 74 is disposed in the retaining device 21 and stiff or rigid means are used on the stamp pad 4. In this manner, a self-inking stamp 1 is produced with a telescoping upper part and lower part 6, 7 as well as a printing plate holder 8 pivotally disposed in the lower part 7 to accommodate the stamp plate 3, wherein a retaining device 21 for a stamp pad 4 is associated with the printing plate holder 8 and in a rest position 2 the printing plate holder 8 is positioned in the range 80° to 135°, in particular at approximately 90° to a contact area 22 and can be displaced via guide means from said rest position 2 into an operating position 23 to produce a stamped imprint, wherein resilient means 74 are disposed in the lower part 7 which protrude into a retaining device 21 for the stamp pad 4 or are almost flush therewith, and at least one further means 74 for positioning and holding the stamp pad 4 is disposed on a further side on the lower part 7. This arrangement of the resilient means 74 means that the stamp pad 4 is forced into a specific position, ensuring a secure hold and accurate positioning. Further, overcoming the force exerted by the resilient means 74 means that the stamp pad 4 can be moved or displaced slightly in the retaining device 4, whereupon it is possible to snap out or release the interlocking means 74, i.e. the means 74 on the stamp pad 4 and the means 74 on the stamp 1 cooperate such that they can be displaced slightly in one direction, in particular opposite to the contact area 22. To this end, resilient means 74 are disposed in the lower part 7 which protrude into the interior of the retaining device 21 for the stamp pad 4 or are almost flush therewith, and two further means, in particular two recesses 54, are provided on a further side on the lower part 7 to position and hold the stamp pad 4 so that the stamp pad 4 can be pushed against the resilient means 74.

The corresponding stamp pad 4 is thus constructed such that it comprises a stamp pad carrier 56 and an insert disposed therein to take up ink, and means 74 are disposed on the stamp pad carrier 56 for inserting into and/or removal from a stamp 1, wherein at least one means 74 is provided for insertion into a corresponding means 74 in a stamp 1, and that on a further side a further means 74 is provided for positioning and holding. In this manner, the stamp pad carrier 56 has a specific thickness 100 that can accommodate the insert 51 and thus provide an appropriate ink reservoir for a plurality of stamping procedures. In general, it should be mentioned that the insert 51 is freely accessible on one side of the stamp pad carrier 56 and the other side is covered by the stamp pad carrier 56. In this manner, 1 in the rest position it is possible for the printing plate holder 8 of a stamp, when the stamp pad 4 has been inserted, to sit directly on the insert 51 and thus it can take up ink, i.e. the stamp pad 4 is inserted in the stamp 1 in such a manner that the insert 51 protrudes in the direction of the window 96 of the retaining device 21 so that the printing plate holder 8 makes contact with the insert 51 through the window 96 or opening in the rest position and thus exerts a pressure on the insert 52 and thus on the stamp pad 4.

In the embodiment shown, on one long side face 106 of the stamp pad 4, two projections 58 are disposed which are constructed for insertion in recesses 54 on the top face of the lower part 7 of the stamp 1, wherein on the opposite side two further projections 58 are disposed for insertion in the recesses on the longitudinal web 98 of the lower part 7 of the stamp 1. The two projections 58 are disposed on a central web 107 or long side face which borders the region for the insert 51. A further long side face 108 is disposed parallel to the central web 107, and between the central web 107 and the long side face 108 is a space 109 which is constructed such that at least the longitudinal web on the lower part 7 can be disposed therein, i.e. when the stamp pad 4 is inserted, the longitudinal web 98 is introduced into the space 109 between the central web 107 and the long side face 108, whereupon snap fitting of the projections 58 on the central web 107 into the recesses 54 on the longitudinal web is possible. Furthermore, grasping elements 77 are disposed or formed on both short side faces 110, which protrude beyond the short side faces 110 and are flush with the outer face of the lateral guides 103 when the stamp pad 4 is inserted. In this manner, the short side faces 110 can run inside the lateral guides 103 and the grasping elements 77 of the stamp pad 4 are flush with the outer surface of the lateral guide 103. In addition, it is possible for a kind of facet 111 to be disposed in the lateral regions of the short side face 110. It is also possible for openings 112 to be disposed in the regions of the projections 58 on the central web on the stamp pad carrier 56, as illustrated.

In order to insert the stamp pad 4, it is only necessary to push the stamp pad 4 gently at an angle into the lateral guides. Once the stamp pad 4 makes contact with the projection 90 or the top face 95 of the lower part 7, the user now has to exert a slight pressure in the direction of the top face 95 so that the resilient means 74, in particular the resilient projection 90, is pushed backwards. At the same time, the stamp pad 4 moves in the direction of the top face 95, so that the projections 58 in the region of the longitudinal web 98 are pushed over and away therefrom and the stamp pad 4 becomes seated on the supporting surface 97. The pressure on the stamp pad 4 is now released, and it is then pushed in the direction of the contact area 22 by the resilient means 74, whereupon the projections 58 in the region of the longitudinal web 98 are pushed into the recesses 54 disposed in the longitudinal web 98. Thus, the stamp pad 4 is securely held in a precise position in the stamp 1 and the pressure is still exerted on the stamp pad 4 by the resilient means 74.

However, if the stamp pad 4 is to be removed from the stamp 1 or changed, it is necessary to exert an appropriate pressure on the stamp pad 4 in the direction of the top face 95 of the lower part 7, whereupon the resilience of the resilient means 74 is removed and overcome so that the stamp pad 4 is pushed in the direction of the top face 95 of the lower part 7. Thus, the means 74 on the stamp pad 4 are released in the region of the longitudinal web 98 or the projections 58 are pushed out of the recesses 54 on the longitudinal web 98, so that a subsequent slight turning movement, in particular against the lower part 7, on at least one side of the retaining device 21 moves it out so that the load can be released and the stamp pad 4 can simply be pulled out since the individual means 74 of the stamp pad 4 and the stamp 1 are no longer in engagement.

It could thus be said that a method has been developed in which insertion and exchange of the stamp pad is accomplished by initially exerting a pressure against the contact area 22 of the stamp 1 and against the resilience of the resilient means 74 on the lower part 7, and then turning the stamp pad 4 positions or removes it.

To optimize the hold of the stamp pad 4 in the retaining device 21 of the lower part 7, in this regard four means 74, in particular four projections 58, are disposed on the stamp pad 4. They are preferably disposed in pairs on the long sides. These means 74, in particular these projections 58, however, have another purpose, namely that these projections 58 are constructed so that they act against the downward force of the printing plate holder 8, or the stamp pad 4 is held against the downward pressure of the printing plate holder 8 by these projections 58. So that, for example, only specific stamp pads 4 can be inserted in a specific stamp 1, it is possible for the means 74, in particular the projections 58, to be arranged asymmetrically on the stamp pad 4 and for the associated recesses 54 to be constructed to match, i.e. the projections 58 could be at different distances from the border of the stamp pad 4. This means that a kind of coding system can be produced.

Furthermore, it is also possible to insert a stamp pad 4 which ends with the central web 107, i.e. only the region of the insert 51 with the projections 58 on both sides is present so that when inserting the stamp pad 4 in the stamp 1 it is inserted between the top face 95 with the recesses 54 and the resilient projection 90 and the longitudinal web 98 with the recesses 54, so that the stamp pad 4 does not protrude over the stamp pad 4, i.e. a shorter stamp pad 4 is used. The longitudinal web 98 thus forms the termination of the stamp pad 4. Clearly, it is possible, however, for the stamp pad 4 to protrude over part of the longitudinal web 98, so that it can be removed from the stamp 1 more easily. If the stamp pad ends within the longitudinal web 98, it is barely possible to remove it with ease for changing since the longitudinal web 98 and the lateral guides 103 on the side make it harder or obstruct access to the inserted stamp pad 4.

It should be mentioned in this regard that for disposable stamps, as will be described below, appropriate snap fit elements 113 can be inserted which only allow the stamp pad 4 to be inserted once, i.e. after inserting the stamp pad 4, they can only be removed again with the use of a great deal of force, which usually deforms the snap fit element 113.

Figure 50:
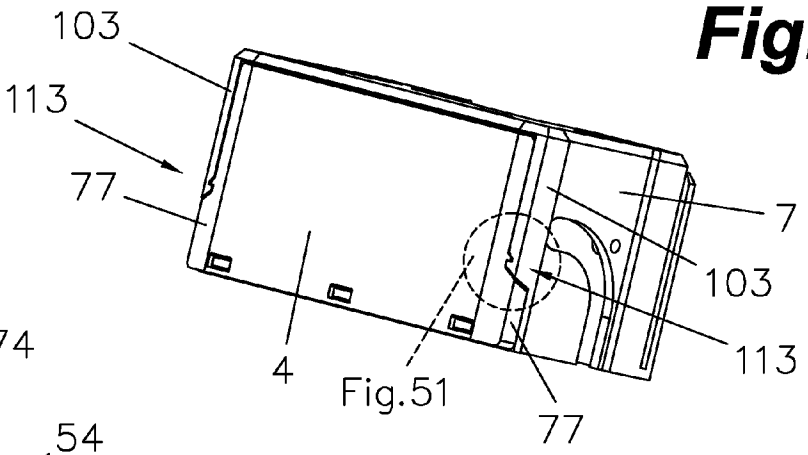
FIG. 50 shows a perspective view of the stamp pad for a disposable stamp of FIG. 50.
Figure 51:
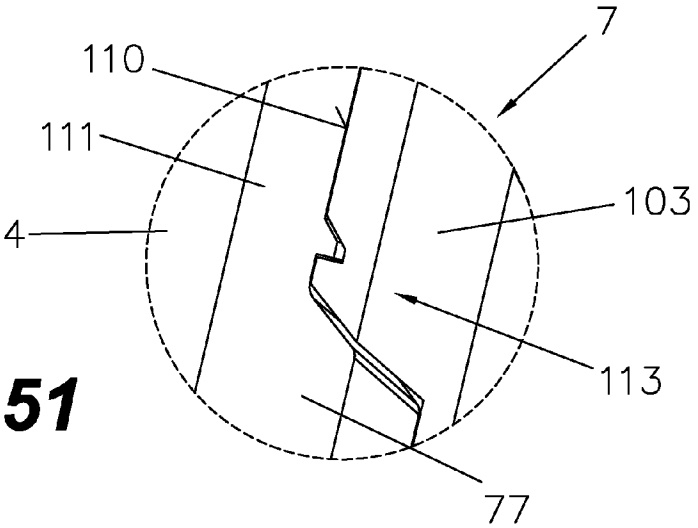
FIG. 51 shows an enlarged view of a snap fit connection for the disposable stamp of FIGS. 49 and 50.
Figure 49:
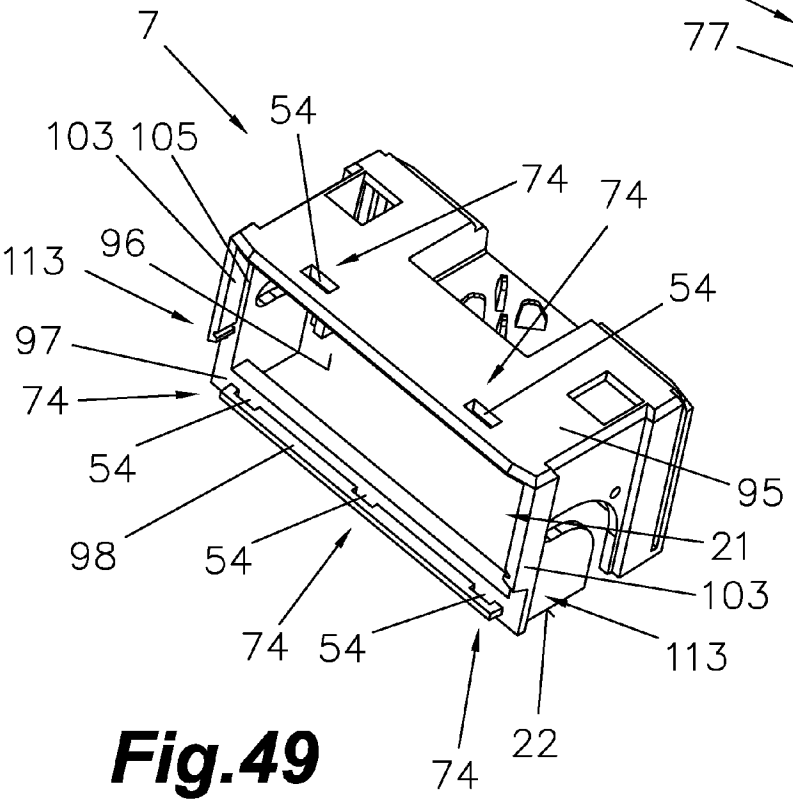
FIG. 49 shows a perspective view of the lower part for a disposable stamp embodiment.

Such an embodiment is shown in FIGS. 49 to 51. These show that when, as can be seen in FIG. 50, a stamp pad 4 is inserted between the short side faces 110 of the stamp pad 4 and the lateral guide 103, a snap fit connection 113 is produced, which is difficult to break. Further, in this embodiment, the space 114 between the short side face 110 or the grasping element 77 and the lateral guide 103 is absent, so that after snap fitting the stamp pad 4 in the lower part 7, it can no longer be moved. Clearly, it is also possible to dispose this or an additional snap fit connection 113 between the central web 107 and the longitudinal web 98. In such a disposable stamp, it is also not necessary for the resilient means 74 to be disposed on the top face 95 since the aim here is in fact to insert the stamp pad 4 only once and then never to remove it. Thus, the stamp pad 4 can be constructed and inserted without any play. To this end, an additional means 74 in the form of a recess 54 is provided on the longitudinal web 98, for example, to improve retention of the stamp pad 4 in the lower part 7. Furthermore, the stamp pad 4 is slightly different in construction and no longer has the ridges for the grasping element 77 to provide a secure grip, but rather it only has indentations in the form of the grasping elements 77 to provide an even flush fit or to improve the visual appearance of the stamp 1.

However, the recesses 54 on the top face 95 may be dispensed with, if positioning is accomplished via the resilient projection 90, i.e. for example, a notch is provided on the stamp pad 4, into which the projection 90 can be inserted for positioning and simultaneously, however, the projection 90 is deformed to develop a pressure from the stamp pad 4. In this regard, the projection 90 is advantageously constructed so that the stamp pad 4 cannot be tipped out of the lower part 7. Thus, the projection 90 should push the stamp pad 4 in the direction of the contact area and simultaneously push it in the direction of the lower part 7. This can be accomplished, for example, by means of a three-dimensional construction of the pins on the projection 90 which engage in a correspondingly angular notch on the stamp pad 4.

Furthermore, FIGS. 52 to 59 show an embodiment in which the means 74 on the stamp pad 4 are specially constructed so that, for example, insertion can be positionally exact and/or allow for additional exact positioning and/or prevent complete insertion of a wrong, in particular non-matching stamp pad 4. However, in the illustration and description, only two components, namely the stamp 1 and the skilled person 4, are described, even though protection is sought for each individual part, since the two parts, namely the stamp 1 and the stamp pad 4, can also be sold or marketed individually. It could thus be said that a type of coding system has been developed whereby only correctly constructed stamp pads 4 can be inserted. This coding system is designed to make copying of the stamp pads 4 more difficult and also to ensure that only genuinely matching stamp pads 4 can be inserted.

Such systems are becoming ever more important in stamps 1, since the various constructions frequently require very similar stamp pads 4, but they are not all suitable for all stamps 1. Thus, it must be ensured that only those stamp pads 4 that are intended by the manufacturer to fit in a particular stamp 1 can actually be inserted or removed. In particular, it is frequently the case with replica stamp pads that they fit rather poorly in the manufacturer's stamp 1 and most of the time produce a poor stamped imprint or it is a complex matter to change the replica stamp pad. This can ruin the reputation of the manufacturer. A poor stamped imprint may, for example, be obtained when in the rest position, the stamp pad 4 in the stamp 1 does not make full contact with the printing plate of the printing plate holder 8 and thus not enough ink can be taken up.

Furthermore, it is nowadays necessary for the same model of stamp 1 to allow only specific stamp pads 1 to be inserted in the corresponding stamp 1 since, for example, the printing plate for the stamped imprint, the insert 51 and the ink therein are matched, i.e. only a specific ink and/or insert 51 can be used for a specific printing plate. Again, it must be ensured that an appropriate construction of the stamp pad 4 prevents similar stamp pads 4 from being inserted in specific stamps 1.

To this end, the embodiments described and illustrated below describe various embodiments of stamp pads 4 with the appropriate details of the retaining region in the stamp 1. It could thus be said that the embodiments correspond to a coding system.

Figure 53:
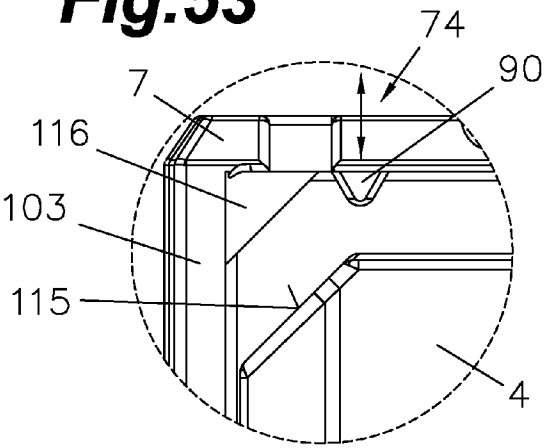
FIG. 53 shows an enlarged view of the embodiment of FIG. 52.
Figure 52:
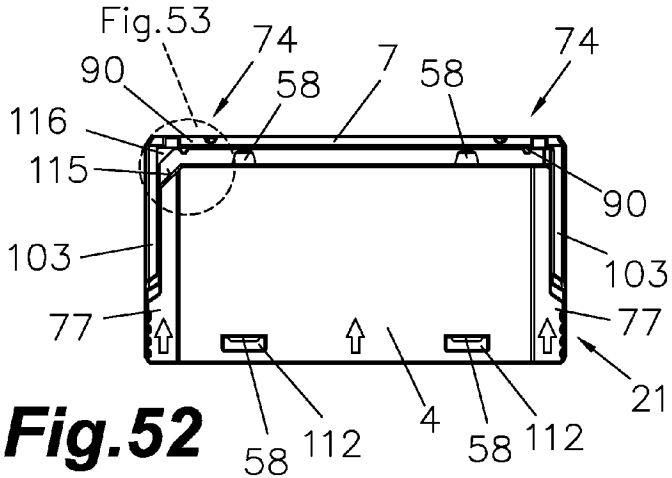
FIG. 52 shows an embodiment with a chamfer/bevel or indentation as an additional means as a simplified, diagrammatic front view.

The embodiment of FIGS. 52 and 53 shows a stamp pad 4 in which an angular chamfer 115/bevel or indentation is disposed on one side. The chamfer 115 extends from the short side face 110 to the long side face 106. Correspondingly, an angular projection 116 is disposed on one side of the stamp 1, in particular on a lateral guide 103 or the top face 95, which matches the chamfer 115. The projection 116 and the chamfer 115 are at the same angle so that on inserting the stamp pad 4 in the stamp 1, these two faces make contact or there is only a very small distance between the two faces.

This construction prevents regular commercial squared-off stamp pads 4 from being inserted into such a retaining device 21, since they would come into contact with the angular projection 116 and thus could not be pushed in completely. Simultaneously, the other positioning means, such as the projections 58, would not engage in the recesses 54 so that a squared-off stamp pad 4 would probably fall out.

Using such a chamfer/bevel or indentation 115 and projection 116 means that different sizes or angles can be employed for a variety of stamp pads 4 for a variety of stamp models, and thus a type of coding system can be built up.

It is also possible for the chamfer/bevel or indentation 115 and the projection 116 not to be constructed as flat angular faces, but to form them from a circular segment with matching radii or to be rectangular, i.e. the chamfer 115 could be semi-circular and could be inserted in a corresponding semi-circular projection 116. Clearly, it is possible for the chamfer/bevel or indentation 115 to be formed from a plurality of surfaces or radii. It is also possible for the surface not to be formed at 90° to the stamp pad carrier 56, but to be at an angle, i.e. to have a third dimension. This means that on insertion of the stamp pad 4, it is simultaneously pushed by the projection 116 into a specific position and so almost all of the stamping area can be used. It is also possible to have chamfers 115 and projections 116 on both sides of the stamp pad 4 or the retaining device 21 which may be the same or different in shape.

In the illustration of FIGS. 52, 53, the chamfer/bevel or indentation 115 extends over the whole width or thickness 100 of the stamp pad 4, whereby the projection 116 in the lower part 7 is correspondingly constructed or only covers a small region.

Figure 55:
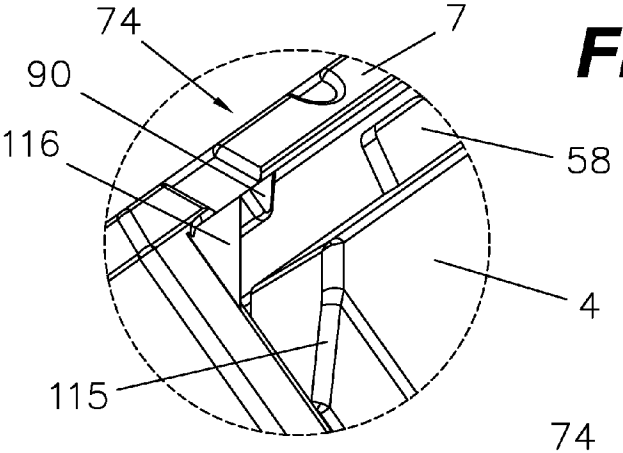
FIG. 55 shows an enlarged view of the embodiment of FIG. 54.
Figure 54:
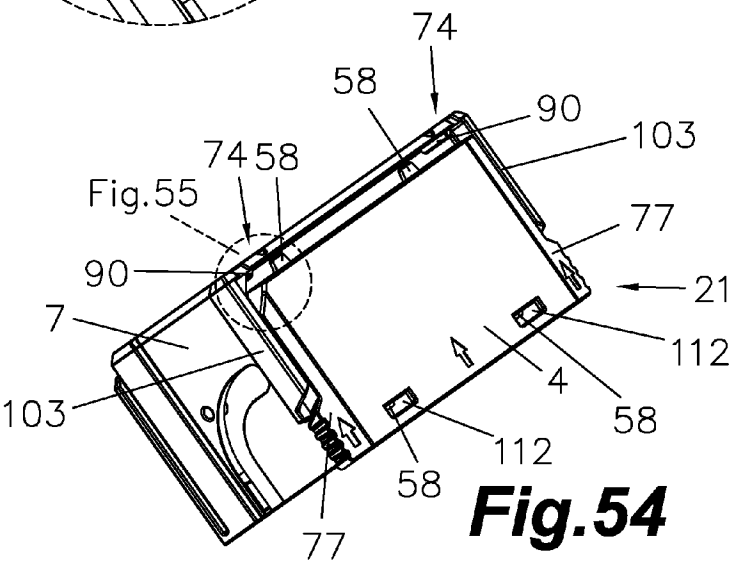
FIG. 54 shows another embodiment with the chamfer/bevel or indentation, in perspective view.

In the embodiment of FIGS. 54 and 55, only a portion of the thickness 100 or height of the stamp pad 4 is provided with a chamfer/bevel or indentation 115, and the remainder of the region is squared off. Thus, in stamp 1, in particular in the lower part 7, only one region is provided with the projection 90 so that upon insertion, the stamp pad with the squared-off region can be pushed under the projection and the chamfer/bevel or indentation 115 comes into contact with the projection 90.

Clearly, it is also possible to form or apply an appropriate knob in the form of a chamfer/bevel or indentation 115; in this event, the lower part 7 would be appropriately equipped.

The further embodiment in FIGS. 54 and 55 shows a cam system. A cam 117 is disposed on the top face 95 of the lower part 7 which protrudes into the interior, in particular into the window 96 of the retaining device 21. Correspondingly, the stamp pad 4 is provided with a recess 118 which accommodates the cam 117 with as little play as possible. The cam 117 thus protrudes into the insert 51 of the stamp pad 4, i.e. when assembling the stamp 1 with the stamp pad 4, the cam 117 is guided into the recess 118 and then presses directly on the insert 51 or, with an appropriately constructed insert 51, it is pushed into a space in the insert 51. By being plunged directly into the insert 51, the largest possible stamped imprint can be produced, since the insert is still present below the cam 117 and thus ink can still be taken up by the printing plate, i.e. the stamped imprint can be produced right up to the edge. In general, it is naturally possible for the housing of the stamp pad 4 to be constructed such that in the region of the cam 117 it forms an appropriate indentation with a specific wall thickness to prevent it from being plunged into the insert 51.

The cam 117 is thus preferably tapered and the corresponding recess 118 has corresponding chamfers so that the tapered cam 117 can be accommodated with as little play as possible. The taper of the cam 117 also means that more insert material is available under the cam 117 and thus ink take-up in the edge region is improved.

Positioning of the cam 117 near to the region of the resilient means 74 on the top face 95 has been shown to be advantageous since in the border region of the lower part 7, the top face 95 is appropriately stiff and thus the wall strength does not have to be increased. Preferably, the cam 117 is disposed between the projection 90 and the short side face 110. In addition, the off-centre positioning of the cam 117 means that different positions can be used for different embodiments. It is also possible, for example, to use large cams 117 for the coding.

Figure 57:
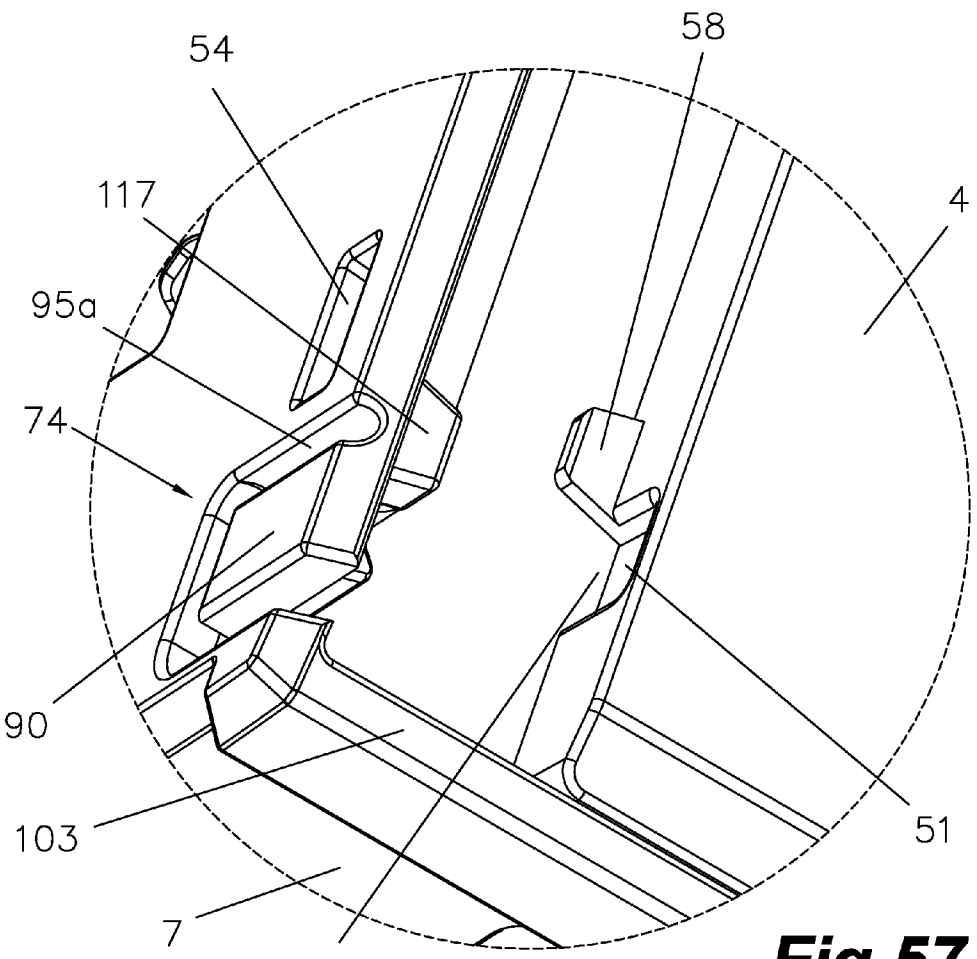
FIG. 57 shows an enlarged view of the embodiment of FIG. 56.
Figure 56:
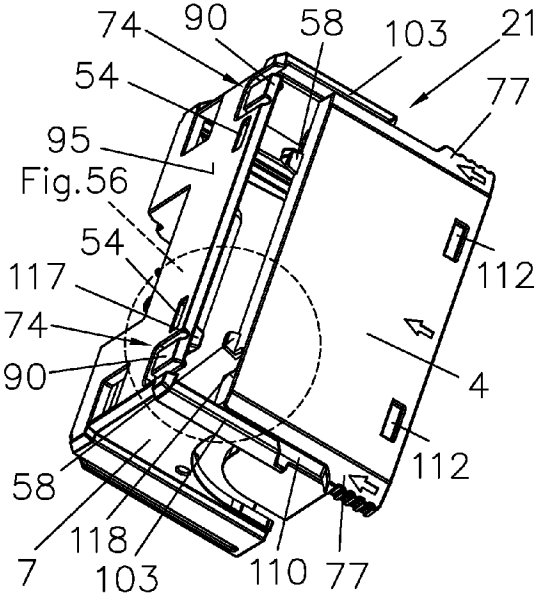
FIG. 56 shows an embodiment with a cam on the lower part and a recess on the stamp pad, in perspective view.
Figure 59:
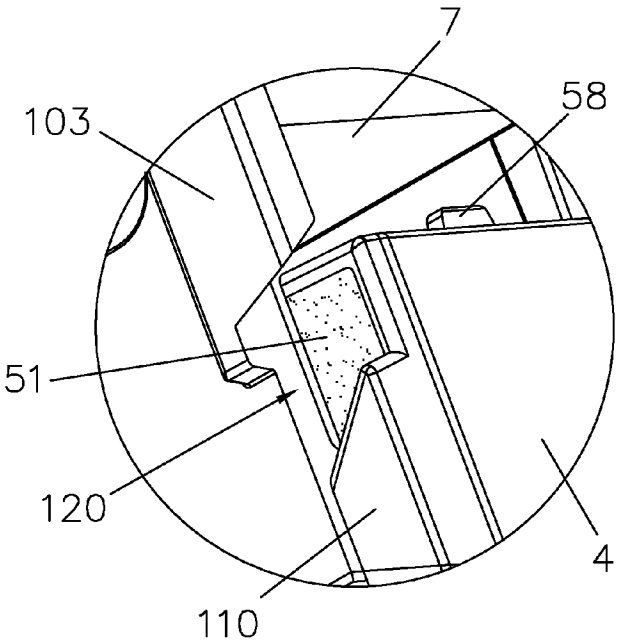
FIG. 59 shows an enlarged view of the embodiment of FIG. 58.
Figure 58:
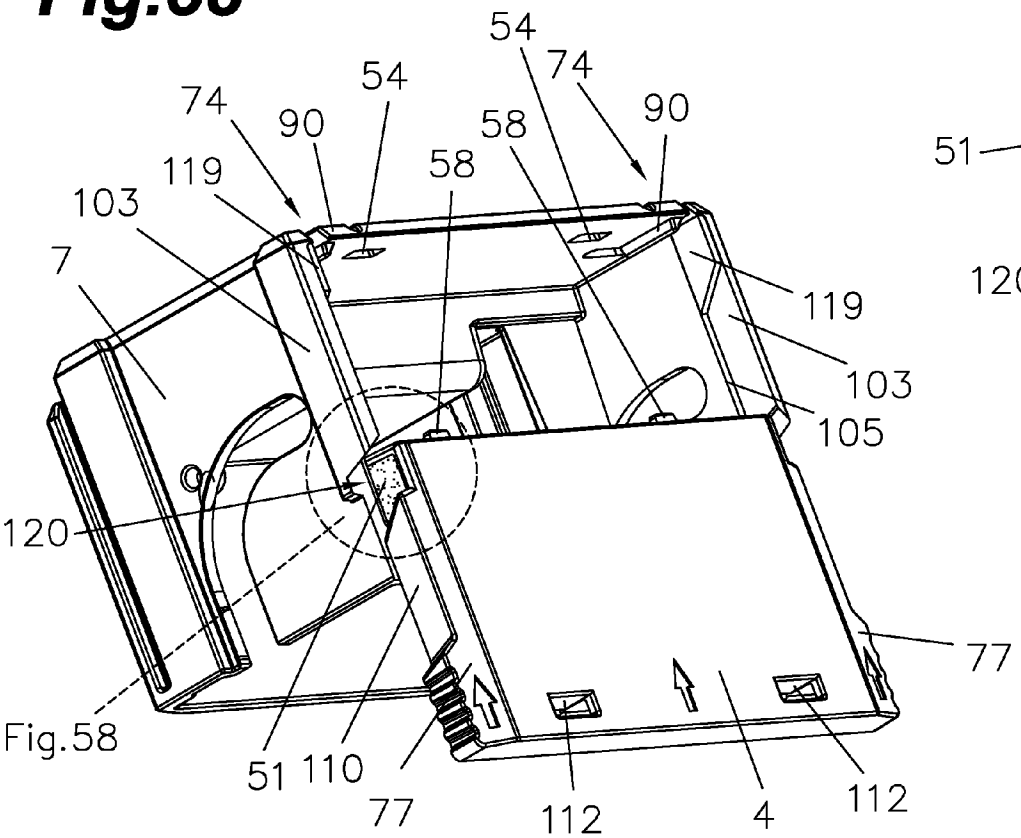
FIG. 58 shows a simplified perspective view of an embodiment with a ramp on the lateral guide of the lower part and an opening on the stamp pad.

FIGS. 56 and 57 show an embodiment in which again, an incorrect stamp pad 4 cannot be fully inserted in the retaining device 21. To this end, a ramp 119 is disposed on one or both lateral guides 103. Correspondingly thereto, a corresponding opening 120 is disposed on the short side face 110 or short side faces 110, i.e. the housing for the stamp pad 4 in this region may be left open. Clearly, it is possible for the housing to be formed so that the ramp 119 is accommodated and formed on the side in the direction of the insert 51 to strengthen the wall. Keeping the stamp pad 4 open means that the insert 51 can again be as large as is possible and thus again, the largest stamped imprint can be produced.

The ramp 119 is constructed so that insertion of the stamp pad 4 pushes the latter over the ramp 110 in an appropriate direction. The hold is thus tight and secure, which is absolutely necessary with multi-colour stamp pads 4, for example.

The advantage of the embodiments described in FIGS. 52 to 59 is that when the stamp pad 4 is inserted in the stamp 1, means 74 of this type prevent complete insertion of the stamp pad 4. Thus, it is not possible for any of the snap fit connections or positioning connections to engage and a wrongly inserted stamp pad 4 can easily be removed again. It is also possible for different means 74 to be combined on one stamp pad 4, for example the chamfer 115 on one side and the ramp 119 on the other side, or the chamfer 115 and the cam 117, etc.

It is possible for a system for preventing full insertion into the retaining device 21 in accordance with the embodiments of FIGS. 52 to 59 when the stamp pad 4 has been inserted, to provide, in the rest position, a space between the elements, for example the chamfer 115 and the projection 116 or the ramp 119 and the opening 120, since the stamp pad 4 is pushed downwards by the resilient projection 90. This space may in fact be necessary because on insertion or removal, the stamp pad 4 has to be displaced in the retaining device 21 in order to be able to introduce the projections 58 in the region of the contact area 22 into the recesses 54 or to remove them. Thus, this means are only in direct contact on insertion or removal. Thus, it is also possible for the means 74 provided in the stamp 1 to prevent insertion of the stamp pad 4 to be constructed resiliently, i.e. insertion of the stamp pad 4 causes these means 74, for example the projections 90, to be bent or pushed away so that when they line up the stamp pad 4 can be inserted and for removal, again the stamp pad 4 has to be displaced, and so the means 74 are again pushed away and then the stamp pad 4 can be removed.

It should also be pointed out that in the embodiments described above, the stamp 1 provided with a turning mechanism of approximately 90° can also be provided with a date. When transporting a stamp of this type, it is also clearly possible to use appropriate caps or locking devices.

In general it should be pointed out that the individual embodiments of FIGS. 1 to 41 described above may be condensed or combined into a single stamp 1 or stamp pad 4, i.e. the individual elements or parts could be matched with the appropriate technical solutions as described in FIGS. 1 to 41 so that the individual solutions may be combined and applied.

Finally, for the purposes of clarity, it should be pointed out that in order to provide a better understanding of the construction of the stamp 1, it and its components have at times been depicted on a different scale and/or enlarged and/or reduced in size.

The individual inventive solutions forming the basis of the invention can be ascertained from the description.

Above all, the individual embodiments shown in FIGS. 1 to 41 may form the subject matter of independent inventive solutions. The aims and solutions of the invention pertaining thereto can be ascertained from the detailed description of these figures.

The invention claimed is:

1. A self-inking stamp comprises a telescoping upper and lower part as well as a printing plate holder pivotally disposed in the lower part to accommodate stamp plate, wherein a retaining device for a stamp pad is associated with the printing plate holder, and in a rest position a mounting surface, of the printing plate holder, is positioned in a range of 80° to 135° with respect to a contact area and can be displaced from said rest position into an operating position to produce a stamped imprint, wherein the printing plate holder is turned about two guide pins, wherein at least one of the two guide pins is respectively disposed on a side face of the printing plate holder, and the two guide pins simultaneously engage in guide slots in the upper and lower part, and wherein means are disposed in the retaining device for fixing and removing the stamp pad in the direction in which the printing plate holder is urged while in the rest position.

2. The self-inking stamp according to claim 1 wherein the guide slot in the upper part is essentially horizontally orientated.

3. The self-inking stamp according to claim 1, wherein the guide slot in the upper part is arcuate.

4. The self-inking stamp according to claim 1, wherein the guide slot in the lower part is essentially vertically orientated.

5. The self-inking stamp according to claim 4, wherein the guide slot in the lower part extends into the contact area.

6. The self-inking stamp according to claim 1, wherein the guide slot in the lower part is arcuate.

7. The self-inking stamp according to claim 1, wherein a ledge is disposed in the lower part, formed as an abutment or stop for the printing plate holder.

8. The self-inking stamp according to claim 1, wherein the lower part includes a front side, and the 1 retaining device for insertion of a stamp pad is disposed in the front side of the lower part.

9. A self-inking stamp comprises a telescoping upper and lower part as well as a printing plate holder pivotally disposed in the lower part to accommodate a stamp plate, the lower part including a front side, wherein a retaining device for a stamp pad is disposed on the front side and associated with the printing plate holder, and in a rest position a mounting surface, of the printing plate holder, is positioned in a range of 80° to 135° with respect to a contact area and can be displaced from said rest position into an operating position to produce a stamped imprint, wherein the retaining device for the stamp pad is constructed such that in the rest position the printing plate holder is accessible via the front side of the lower part, and wherein means are disposed in the retaining device for fixing and removing the stamp pad in the direction in which the printing plate holder is urged while in the rest position.

10. The self-inking stamp according to claim 9, wherein one or more support surfaces to support the stamp pad are disposed in the retaining device.

11. The self-inking stamp according to claim 9, wherein the retaining device has means for positioning, holding and releasably fixing a stamp pad.

12. The self-inking stamp according to claim 9, wherein the means are formed as a recess and/or as a projection.

13. The self-inking stamp according to claim 9, wherein the upper part includes a front side having a lower border, and the retaining device includes an upper border, when in the rest position, the lower border of the front side of the upper part is flush with the upper border of the retaining device or only slightly protrudes beyond it.

14. The self-inking stamp according to claim 9, wherein the retaining device is constructed for insertion or removal of the stamp pad in the direction opposite to the mounting surface of the printing plate holder in the rest position.

15. A self-inking stamp comprising a telescoping upper and lower part as well as a printing plate holder pivotally disposed in the lower part to accommodate a stamp plate, wherein a retaining device for a stamp pad is associated with the printing plate holder and in a rest position a mounting surface, of the printing plate holder, is positioned in a range of 80° to 135° with respect to a contact area and can be displaced from said rest position into an operating position to produce a stamped imprint via guide means, wherein the retaining device for the stamp pad is disposed on the front side and means are disposed in the retaining device for fixing and removing the stamp pad in the direction in which the printing plate holder is urged while in the rest position.

16. The stamp according to claim 15 wherein a resilient means is formed by a projection which is disposed on a top face of the lower part.

17. The stamp according to claim 15, wherein a further means, in particular two further recesses, are disposed on a longitudinal web of the lower part.

18. The stamp according to claim 15, wherein two further recesses are disposed on a top face to position and hold the stamp pad.

19. The stamp according to claim 15, wherein lateral guides are disposed on the lower part and extend from a top face in the direction of the contact area and end at a distance from the contact area.

20. The stamp according to claim 15, wherein a web is disposed between lateral guides to seat the stamp pad.

21. The stamp according to claim 15, wherein a projection corresponding to a chamfer on a stamp pad is disposed on at least one side, in particular a lateral guide or the top face.

22. The stamp according to claim 15, wherein a cam for a recess on the stamp pad is disposed on the top face of the lower part and protrudes into the retaining device.

23. The stamp according to claim 15, wherein a ramp for a corresponding opening on the stamp pad is disposed on one or both lateral guides.

24. A self-inking stamp comprising a telescoping upper and lower part as well as a printing plate holder pivotally disposed in the lower part to accommodate a stamp plate, wherein a retaining device for a stamp pad is associated with the printing plate holder and in a rest position a mounting surface, of the printing plate holder, is positioned in a range of 80° to 135° with respect to a contact area and can be displaced from said rest position into an operating position to produce a stamped imprint via guide means, wherein a resilient means is disposed in the lower part which protrudes into a retaining device for the stamp pad or is almost flush therewith, and in that on a further side on the lower part at least one further means is disposed for positioning and holding the stamp pad, and wherein means are disposed in the retaining device for fixing and removing the stamp pad in the direction in which the printing plate holder is urged while in the rest position.

25. The stamp according to claim 24 wherein the resilient means is formed by a projection which is disposed on a top face of the lower part.

26. The stamp according to claim 24, wherein the further means, in particular two further recesses, are disposed on a longitudinal web of the lower part.

27. The stamp according to claim 24, wherein two further recesses are disposed on a top face to position and hold the stamp pad.

28. The stamp according to claim 24, wherein the lateral guides are disposed on the lower part and extend from a top face in a direction of the contact area and end at a distance from the contact area.

29. The stamp according to claim 24, wherein a web is disposed between lateral guides to seat the stamp pad.

30. The stamp according to claim 24, wherein a projection corresponding to a chamfer on a stamp pad is disposed on at least one side, in particular a lateral guide or the top face.

31. The stamp according to claim 24, wherein a cam for a recess on the stamp pad is disposed on the top face of the lower part and protrudes into the retaining device.

32. The stamp according to claim 24, wherein a ramp for a corresponding opening on the stamp pad is disposed on one or both lateral guides.

* * * * *